US007779805B2

(12) United States Patent
Katsumata et al.

(10) Patent No.: US 7,779,805 B2
(45) Date of Patent: Aug. 24, 2010

(54) SEALED LASH ADJUSTER AND METHOD FOR ADJUSTING AMOUNT OF LIQUID SEALED IN SEALED LASH ADJUSTER

(75) Inventors: Shouji Katsumata, Gotemba (JP); Akihiko Hosaka, Hadano (JP); Ryo Kojima, Hadano (JP); Junichi Kawakita, Hadano (JP)

(73) Assignees: Toyota Jidosha Kabushiki Kaisha, Toyota (JP); Nittan Valve Co., Ltd., Hadano-shi (JP)

( * ) Notice: Subject to any disclaimer, the term of this patent is extended or adjusted under 35 U.S.C. 154(b) by 257 days.

(21) Appl. No.: 12/084,379

(22) PCT Filed: Nov. 8, 2006

(86) PCT No.: PCT/IB2006/003149

§ 371 (c)(1),
(2), (4) Date: Apr. 30, 2008

(87) PCT Pub. No.: WO2007/054787

PCT Pub. Date: May 18, 2007

(65) Prior Publication Data

US 2009/0090324 A1 Apr. 9, 2009

(30) Foreign Application Priority Data

Nov. 8, 2005 (JP) ..... 2005-323591
Sep. 1, 2006 (JP) ..... 2006-238134

(51) Int. Cl.
*F01L 1/14* (2006.01)

(52) U.S. Cl. ..... 123/90.52; 123/90.45; 123/90.48

(58) Field of Classification Search ..... 123/90.39, 123/90.44, 90.45, 90.46, 90.48, 90.52, 90.55; 74/559, 567, 569; 403/114, 165; 277/345, 277/351

See application file for complete search history.

(56) References Cited

U.S. PATENT DOCUMENTS 2,096,257 A 10/1937 Moorhouse (Continued)

FOREIGN PATENT DOCUMENTS

EP 0 010 768 A1 5/1980

(Continued)

OTHER PUBLICATIONS

Korean Office Action issued Apr. 23, 2010 in Korean Application No. 10-2008-7010952 with English translation.

*Primary Examiner*—Ching Chang
(74) *Attorney, Agent, or Firm*—Oliff & Berridge, PLC

(57) ABSTRACT

The liquid is sealed in the lash adjuster so that the volume "V1" of the gas, in the reservoir chamber when the lash adjuster is being produced and the plunger protrudes from the body, is equal to or more than 1.24 times as great as the sum of the volume "Vo1" of the liquid discharged from the high-pressure chamber when the plunger moves downward, and the increase "Vo2" in the volume of the liquid that expands, due to heat, when the temperature of the gas in the reservoir chamber is increased from the production temperature to the maximum use temperature, and the ratio of "V1" to "Vo1+Vo2" is equal to or higher than a ratio, which is derived based on the production temperature and the maximum use temperature, when the inner pressure of the lash adjuster increases by 500 kPa at maximum.

17 Claims, 19 Drawing Sheets

U.S. PATENT DOCUMENTS

| | | | | |
|---|---|---|---|---|
| 2,109,816 | A | 3/1938 | Best | |
| 2,737,934 | A | 3/1956 | Banker | |
| 2,784,707 | A | 3/1957 | Skinner | |
| 2,807,251 | A | 9/1957 | Peras | |
| 3,025,842 | A | 3/1962 | Slooten | |
| 3,670,707 | A | 6/1972 | Guido | |
| 4,385,559 | A | 5/1983 | Hori et al. | |
| 6,871,622 | B2 * | 3/2005 | Mandal et al. | 123/90.52 |
| 2005/0188938 | A1 | 9/2005 | Masello et al. | |

FOREIGN PATENT DOCUMENTS

| | | |
|---|---|---|
| GB | 2 209 574 A | 5/1989 |
| JP | A 59-099012 | 6/1984 |
| JP | U 1-124008 | 8/1989 |
| JP | A 2003-083010 | 3/2003 |

* cited by examiner

FIG. 12

| INNER PRESSURE INCREASE UPPER LIMIT (kPa) | REFERENCE VOLUME (Vo1 + Vo2) | RATIO OF VOLUME OF GAS DURING PRODUCTION TO REFERENCE VOLUME |
|---|---|---|
| 100 | 30.80 | 3.25 |
| 200 | 53.77 | 1.86 |
| 300 | 65.29 | 1.53 |
| 400 | 72.21 | 1.38 |
| 500 | 76.83 | 1.30 |
| 600 | 80.14 | 1.25 |
| 700 | 82.62 | 1.21 |
| 800 | 84.54 | 1.18 |
| 900 | 86.09 | 1.16 |
| 1000 | 87.35 | 1.14 |

SEALED LASH ADJUSTER AND METHOD FOR ADJUSTING AMOUNT OF LIQUID SEALED IN SEALED LASH ADJUSTER

BACKGROUND OF THE INVENTION

1. Field of the Invention

The invention relates generally to a sealed lash adjuster and a method for adjusting the amount of liquid sealed in the sealed lash adjuster. More specifically, the invention relates to a sealed lash adjuster and a method for adjusting the amount of liquid sealed in the sealed lash adjuster, with which the inner pressure of the lash adjuster is maintained at or lower than a threshold value without increasing the size of the lash adjuster.

2. Description of the Related Art

A lash adjuster, which automatically adjusts a valve clearance between an intake/exhaust valve and a cylinder head of an internal combustion engine to a value at or around zero, has been brought into practical use. With this lash adjuster, noise due to contact between the intake/exhaust valve and the cylinder head is prevented, and the routine adjustment of the valve clearance is no longer necessary. Examples of such lash adjusters include an externally-oiled lash adjuster that uses the engine oil. If an inappropriate amount of engine oil is supplied or deteriorated oil is continuously used in the externally-oiled lash adjuster, more air or foreign matter may be mixed into the oil. As a result, the lash adjuster may fail to function properly. In other words, whether the externally-oiled lash adjuster properly functions depends on whether the amount and condition of the engine oil supplied thereto are controlled appropriately. However, with a sealed lash adjuster in which liquid such as oil is sealed, the above-described factor responsible for a possible functional failure may be removed. For example, Japanese Utility Model Application No. 01-124008 proposes a sealed lash adjuster described below.

The sealed lash adjuster described in Japanese Utility Model Application No. 01-124008 contains magnetic fluid. In addition, the sealed lash adjuster is provided with a magnet serving as sealing means for sealing a gap between the sliding face of a plunger and the body of the lash adjuster. In the sealed lash adjuster, leakage of the magnetic fluid through the gap is prevented using a phenomenon in which the viscosity of fluid significantly increases in a magnetic field formed by a magnet. As a result, the fluid is sealed in the lash adjuster with high reliability.

In the sealed lash adjuster, when the plunger moves downward, the liquid is pushed out of a high-pressure chamber and moves into a reservoir chamber, and the liquid compresses the gas in the reservoir chamber. As a result, the inner pressure increases in the reservoir chamber. Also, when the sealed lash adjuster is used in an internal combustion engine, the temperatures of the liquid and the gas in the lash adjuster increase due to heat transferred from the internal combustion engine. Such increases also contribute to increases in the inner pressure.

Because increases in the inner pressure promote wearing-out of the sealing means, the sealing means needs to have high wear resistance. However, providing the sealing means with high wear resistance increases the production cost of the lash adjuster. In addition, because increases in the inner pressure increase the amount of gas dissolved in liquid, mixing of the gas into the liquid is further promoted. As a result, the sealed lash adjuster may fail to function properly. Further, as the inner pressure increases, friction increases in a valve system because an unnecessarily strong force is applied, due to such increased inner pressure, between the sealed lash adjuster and a rocker arm, between the rocker arm and a cam, between the rocker arm and an intake/exhaust valve, etc. As a result, wearing-out of a sliding portion may be promoted.

Meanwhile, the size of the sealed lash adjuster is restricted because the sealed lash adjuster shares a limited space with components such as the valve system and a cylinder head. Therefore, the sealed lash adjuster should be as compact as possible. The compact lash adjuster also provides high degree of flexibility in design of the entire portion near the lash adjuster, including the components described above. However, the inner pressure and the size of the lash adjuster are not described in Japanese Utility Model Application No. 01-124008.

SUMMARY OF THE INVENTION

The invention provides a sealed lash adjuster and a method for adjusting the amount of liquid sealed in the sealed lash adjuster, with which the inner pressure of the lash adjuster is maintained at or lower than a threshold value without increasing the size of the lash adjuster.

A first aspect of the invention relates to a sealed lash adjuster including a moving member that has a reservoir chamber filled with liquid and gas, a through-hole that extends from a sliding face of the moving member to the reservoir chamber, and a communication hole that is formed in a high-pressure-chamber-side end portion of the moving member and that permits communication between the reservoir chamber and a high-pressure chamber; a body in which the moving member is slidably housed; fluid backflow prevention means arranged in the communication hole; and a force-applying member that is arranged in the high-pressure chamber and that applies a force to the moving member to promote protrusion of the moving member from the body. The liquid is sealed in the lash adjuster so that the volume of the gas, which is present in the reservoir chamber when the lash adjuster is being produced and the moving member protrudes from the body to the fullest extent, is equal to or more than 1.24 times as great as the sum of the volume of liquid, that is discharged from the high-pressure chamber when the moving member, which has protruded from the body to the fullest extent, is moved downward to the fullest extent, and the increase in the volume of the liquid which expands, due to heat, when the temperature of the gas in the reservoir chamber changes from the production temperature when the lash adjuster is being produced to the maximum use temperature when the lash adjuster is in use; and so that the ratio of the volume of the gas present in the reservoir chamber during production of the lash adjuster to the sum is equal to or higher than the ratio that is derived, based on the production temperature and the maximum use temperature corresponding to the production environment and the use environment, from the temperature range defined by the production temperature and the maximum use temperature, which corresponds to the ratio of the volume of the gas present in the reservoir chamber during production of the lash adjuster to the sum when the inner pressure of the lash adjuster increases by 500 kPa at maximum.

In the first aspect of the invention, the temperature range may be defined by the production temperature of 30° C. and lower and the maximum use temperature of 80° C. and higher.

According to the first aspect, the temperature range corresponding to the ratio when the inner pressure of the lash adjuster increases by 500 kPa at maximum is defined by the production temperature and the maximum use temperature. Further, the common temperature range may be defined by the production temperature of 30° C. and lower and the maximum use temperature of 80° C. and higher. Thus, the ratio at which the increase in the inner pressure is maintained at 500 kPa in the common production environment and the use environment is more clearly determined. In other words, according to the first aspect of the invention, if the liquid is sealed in the lash adjuster so that the ratio which is derived, from the temperature range corresponding to the ratio when the inner pressure increases by 500 kPa at maximum, based on the production temperature and the maximum use temperature corresponding to the common production environment and use environment, is achieved, the increase in the inner pressure is maintained at 500 kPa. If the liquid is sealed in the lash adjuster so that a ratio that is higher than the ratio derived in the above-mentioned manner is achieved, the increase in the inner pressure is maintained at or below 500 kPa. According to the first aspect of the invention, the increase in the inner pressure is maintained at or below 500 kPa under the condition where the production temperature and the maximum use temperature are common values. The first aspect includes three example forms described below. According to the first aspect of the invention, the temperature range corresponding to the ratio at which the increase in the inner pressure is maintained at or below 500 kPa under the condition where the production temperature and the maximum use temperature are common values is defined more clearly. As a result of examination, the lowest value of the ratio at which the increase in the inner pressure is suppressed at or below 500 kPa is set to 1.24, and the lower limit of the common production temperature is decreased from 10° C.

A first form of the first aspect of the invention relates to the sealed lash adjuster including the moving member that has the reservoir chamber filled with liquid and gas, the through-hole that extends from the sliding face of the moving member to the reservoir chamber, and the communication hole that is formed in the high-pressure-chamber-side end portion of the moving member and that permits communication between the reservoir chamber and the high-pressure chamber; the body in which the moving member is slidably housed; the fluid backflow prevention means arranged in the communication hole; and the force-applying member that is arranged in the high-pressure chamber and that applies a force to the moving member to promote protrusion of the moving member from the body. The liquid is sealed in the lash adjuster so that the volume of the gas, which is present in the reservoir chamber when the lash adjuster is being produced and the moving member protrudes from the body to the fullest extent, is equal to or more than 1.34 times as great as the sum of the volume of liquid, that is discharged from the high-pressure chamber when the moving member, which has protruded from the body to the fullest extent, is moved downward to the fullest extent, and the increase in the volume of the liquid which expands, due to heat, when the temperature of the gas in the reservoir chamber changes from the production temperature when the lash adjuster is being produced to the maximum use temperature when the lash adjuster is in use.

Because the liquid and the gas in the reservoir chamber expand with increases in the temperature, the maximum inner pressure of the sealed lash adjuster is reached when the temperature is highest under a given use environment and the moving member has moved downward to the fullest extent. Accordingly, it is necessary to determine the maximum value to which the temperature of the atmosphere around the sealed lash adjuster is increased. The highest temperature in the common use environment may be employed as the temperature of the atmosphere around the sealed lash adjuster in use. Thus, when the sealed lash adjuster is employed in the atmosphere having the temperature lower than the highest temperature in the common use environment, the maximum inner pressure is maintained at or below the threshold value.

Even under the same use environment, the maximum inner pressure varies depending on the temperature of the atmosphere present around the sealed lash adjuster during its production. As the temperature of the atmosphere around the sealed lash adjuster during its production decreases, the difference between the maximum use temperature and the production temperature increases, and the gas and the liquid expand more. This increases the inner pressure. Therefore, the lowest temperature in the common production environment may be employed as the temperature of the atmosphere around the lash adjuster during its production. Thus, when the sealed lash adjuster is produced in the atmosphere having the temperature equal to or higher than the lowest temperature in the common production environment, the inner pressure is maintained at or lower than the threshold value. Accordingly, if the highest temperature in the common use environment is employed as the temperature of the atmosphere around the sealed lash adjuster in use and the lowest temperature in the common production environment is used as the temperature of the atmosphere around the lash adjuster during its production, it is possible to maintain the maximum inner pressure of the lash adjuster at or below the threshold value in the common production environment and use environment.

In the first form of the first aspect of the invention, it is estimated that the temperature of the gas under the common production environment (hereinafter, simply referred to as the "production temperature") is in the range from 10° C. to 30° C., and the maximum temperature of the gas in the common use environment (hereinafter, simply referred to as the "maximum use temperature") is in the range from 80° C. to 150° C. In such environment, the inner pressure of the lash adjuster is maintained at or below the inner pressure that is higher than the atmospheric pressure by 500 kPa. According to the first form of the first aspect of the invention, even when the production temperature is 10° C., which is the lowest value, and the maximum use temperature is 150° C., which is the highest value, the increase in the inner pressure is maintained at or below 500 kPa. Namely, in the condition where the production temperature and the use temperature are common values, the inner pressure of the sealed lash adjuster is maintained at or below the inner pressure that is higher than the atmospheric pressure by 500 kPa.

If the maximum inner pressure of the lash adjuster is not maintained at or below the atmospheric pressure by 500 kPa, the probability, for example, that the gas is mixed into the liquid sealed in the lash adjuster increases. Based on this, the limit of an increase in the inner pressure is set to 500 kPa. Accordingly, the maximum inner pressure is not limited to the inner pressure higher than the atmospheric pressure by 500 kPa, as long the maximum inner pressure is higher than the atmospheric pressure by 500 at maximum. The maximum inner pressure may be the inner pressure that is higher than the atmospheric pressure by, for example, 300 kPa or 200 kPa. The maximum inner pressure, which is higher than the atmospheric pressure by a value lower than 500 kPa, may be realized if the ratio of the volume of the gas present in the reservoir chamber to the above-mentioned sum (hereinafter, sometimes referred to as the "reference volume") is higher than 1.34.

According to a second form of the first aspect of the invention, the ratio of the volume of the gas present in the reservoir chamber to the reference volume, which is achieved when the moving member protrudes from the body to the fullest extent may be equal to or higher than 1.3. According to the second form, if the volume of the gas present in the reservoir chamber is equal to or higher than 1.3 times as great as the reference volume, when the production temperature is always higher than 20° C. and the maximum use temperature is always lower than 130° C., the inner pressure is maintained at or below the inner pressure that is higher than the atmospheric pressure by 500 kPa. Namely, if the production temperature and the maximum use temperature are specified in more detail instead of taking the entire common production temperature range and the entire common maximum use temperature range into account, the volume of the gas in the reservoir chamber can be reduced. Such reduction makes it possible to reduce the size of the sealed lash adjuster.

According to a third form of the first aspect of the invention, the ratio of the volume of the gas in the reservoir chamber to the reference volume, which is achieved when the moving member protrudes from the body to the fullest extent may be equal to or higher than 1.24. According to the third form, if the volume of the gas present in the reservoir chamber is equal to or higher than 1.24 times as great as the reference volume, when the production temperature is always higher than 30° C. and the maximum use temperature is always lower than 80° C., the inner pressure is maintained at or below the inner pressure that is higher than the atmospheric pressure by 500 kPa. According to the third form, the production temperature and the maximum temperature are specified in more detail in the common production environment and use environment. As a result, the volume of the gas in the reservoir chamber is further reduced. Such reduction makes it possible to further reduce the size of the sealed lash adjuster.

A second aspect of the invention relates to a sealed lash adjuster including a moving member that has a reservoir chamber filled with liquid and gas, a through-hole that extends from the sliding face of the moving member to the reservoir chamber, and a communication hole that is formed in the high-pressure-chamber-side end portion of the moving member and that permits communication between the reservoir chamber and a high-pressure chamber; a body in which the moving member is slidably housed; fluid backflow prevention means arranged in the communication hole; and a force-applying member that is arranged in the high-pressure chamber and that applies a force to the moving member to promote protrusion of the moving member from the body. The liquid is sealed in the lash adjuster so that the ratio of the volume of the gas, which is present in the reservoir chamber when the lash adjuster is being produced and the moving member protrudes from the body to the fullest extent, to the sum of the volume of liquid, that is discharged from the high-pressure chamber when the moving member, which has protruded from the body to the fullest extent, is moved downward to the fullest extent, and the increase in the volume of the liquid which expands, due to heat, when the temperature of the gas in the reservoir chamber changes from the production temperature that is realized when the lash adjuster is being produced to the maximum use temperature that is realized when the lash adjuster is in use is equal to or higher than the ratio that is derived, based on the production temperature and the temperature difference between the production temperature and the maximum use temperature which correspond to the production environment and the use environment, using the correlation established between the temperature difference and the ratio of the volume of the gas present in the reservoir chamber during production of the lash adjuster to the sum when the inner pressure of the lash adjuster increases by an inner pressure increase upper limit. One side of the lash adjuster, which is closer to the high-pressure chamber, will be referred to as the rear end side. The other side of the lash adjuster, which is on the opposite side of the rear end side in the direction in which the moving member slides with respect to the body, will be referred to as the front end side.

Further examination will be made concerning the temperature. For example, the production temperature may vary depending on the season. Therefore, for example, in summer, the production temperature may exceed 30° C. Similarly, the maximum use temperature may exceed the expected common maximum use temperature. In addition, the inner pressure increase upper limit may be provisionally 500 kPa. However, as a result of examination concerning the method for maintaining the increase in the inner pressure at or below 500 kPa as described above, it is found that the ratio of the volume of the gas in the reservoir chamber during production of the lash adjuster to the reference volume, at which the increase in the inner pressure is maintained at 500 kPa, depends on the temperature difference between the production temperature and the maximum use temperature at each production temperature. Based on this, the second aspect of the invention is realized. According to the second aspect of the invention, if the liquid is sealed in the lash adjuster so that a ratio, which is higher than the ratio derived, using the above-mentioned correlation, based on the production temperature and the temperature difference corresponding to the production environment and the use environment, is achieved, the increase in the inner pressure in the lash adjuster is maintained at or below 500 kPa. Thus, the increase in the inner pressure can be maintained at or below 500 kPa, not only in the range where the production temperature and the maximum use temperature are expected common values but also in the other range.

A third aspect of the invention relates to a method for adjusting the amount of liquid sealed in a sealed lash adjuster including a moving member that has a reservoir chamber filled with liquid and gas, a through-hole that extends from the sliding face of the moving member to the reservoir chamber, and a communication hole that is formed in the high-pressure-chamber-side end portion of the moving member and that permits communication between the reservoir chamber and a high-pressure chamber; a body in which the moving member is slidably housed; fluid backflow prevention means arranged in the communication hole; and a force-applying member that is arranged in the high-pressure chamber and that applies a force to the moving member to promote protrusion of the moving member from the body. According to the method, the amount of liquid sealed in the reservoir chamber is adjusted so that the ratio of the volume of the gas, which is present in the reservoir chamber when the lash adjuster is being produced and the moving member protrudes from the body to the fullest extent, to the sum of the volume of liquid, that is discharged from the high-pressure chamber when the moving member, which has protruded from the body to the fullest extent, is moved downward to the fullest extent, and the increase in the volume of the liquid which expands, due to heat, when the temperature of the gas in the reservoir chamber changes from the production temperature when the lash adjuster is being produced to the maximum use temperature when the lash adjuster is in use is equal to or higher than the ratio that is derived, based on the production temperature and the maximum use temperature corresponding to the production environment and the use environment, from the temperature range defined by the production temperature and the maximum use temperature, which corresponds to the ratio of the volume of the gas present in the reservoir chamber during production of the lash adjuster to the sum when the inner pressure of the lash adjuster increases by 500 kPa at maximum, or equal to or higher than the ratio that is derived, based on the production temperature and the temperature difference between the production temperature and the maximum use temperature which correspond to the production environment and the use environment, using the correlation established between the temperature difference and the ratio of the volume of the gas present in the reservoir chamber during production of the lash adjuster to the sum when the inner pressure of the lash adjuster increases by an inner pressure increase upper limit.

The method according to the third aspect of the invention may be performed with the high-pressure chamber of the sealed lash adjuster filled with the liquid. Adjusting the amount of liquid sealed in the reservoir chamber under this condition prevents the gas from entering the high-pressure chamber when the amount of liquid is being adjusted. When the liquid is sealed in the lash adjuster so that the ratio, at which the increase in the inner pressure is maintained at or below, for example, 500 kPa, is achieved, for example, the amount of liquid to be sealed in the lash adjuster may be calculated, the amount of liquid may be converted into the liquid level, and the amount of liquid may be adjusted based on the liquid level.

A fourth aspect of the invention relates to a sealed lash adjuster including a moving member that has a reservoir chamber filled with liquid and gas, a through-hole that extends from the sliding face of the moving member to the reservoir chamber, and a communication hole that is formed in the high-pressure-chamber-side end portion of the moving member and that permits communication between the reservoir chamber and a high-pressure chamber; a body in which the moving member is slidably housed; fluid backflow prevention means arranged in the communication hole; and a force-applying member that is arranged in the high-pressure chamber and that applies a force to the moving member to promote protrusion of the moving member from the body. The reservoir chamber has a region. The area of the cross section of a region of the reservoir chamber, the region being closer to the front end of the moving member, is greater than the area of the cross section of the other region of the reservoir chamber, the other region being closer to the rear end of the moving member, the cross sections being perpendicular to the line extending in the direction in which the moving member slides with respect to the body.

According to the fourth aspect of the invention, the volume of the air sealed in the lash adjuster is increased without increasing the size of the sealed lash adjuster. Namely, the inner pressure of the lash adjuster is maintained low without increasing the size of the sealed lash adjuster.

In the fourth aspect of the invention, the gas may be sealed in the reservoir chamber after being pressurized until the pressure of the gas is higher than the atmospheric pressure. Thus, the inner pressure is prevented from being a negative pressure even when the lash adjuster is used in the environment where the ambient temperature is equal to or lower than 0° C., for example, in a cold district. Thus, atmospheric air, water drops, foreign matter, etc. are prevented from entering the lash adjuster. Also, the inner pressure of the lash adjuster is reliably maintained at or above the atmospheric pressure in the use environment by appropriately controlling the degree of pressurization of the gas based on the use environment.

In the fourth aspect of the invention, the inner pressure of the liquid may be used to apply a force to the moving member instead of the force-applying member. Appropriately adjusting the degree of pressurization of the gas permits the liquid having a pressure higher than the atmospheric pressure to be reliably present in the high-pressure chamber under the expected use environments. Thus, the pressure in the high-pressure chamber is always higher than the atmospheric pressure. Accordingly, in the lash adjuster, a force is applied to the moving member so that the moving member moves upward. In this case, the force-applying member is no longer necessary. With this structure, the production cost of the lash adjuster is reduced, and flexibility in design of the portion near the fluid backflow prevention means is increased.

In the fourth aspect of the invention, the opening portion of the through-hole, which opens into the reservoir chamber, may be below the liquid level. Because the through-hole is always below the liquid level, the gas is prevented from mixing into the liquid.

In the fourth aspect of the invention, the opening portion of the through-hole, which opens into the reservoir chamber, may be closer to the high-pressure chamber than the opening portion of the through-hole, which opens at the sliding face, is, in the direction in which in which the moving member slides with respect to the body. Thus, the through-hole is always below the liquid level even if the liquid level needs to be lowered to increase in volume of the gas. Accordingly, the gas is prevented from mixing into the liquid.

The aspects of the invention described above provide the sealed lash adjuster and the method for adjusting the amount of liquid sealed in the sealed lash adjuster, with which the inner pressure of the lash adjuster is maintained at or lower than the threshold value without increasing the size of the lash adjuster.

BRIEF DESCRIPTION OF THE DRAWINGS

The foregoing and further objects, features and advantages of the invention will become apparent from the following description of example embodiments with reference to the accompanying drawings, wherein the same or corresponding portions will be denoted by the same reference numerals and wherein:

FIG. 12 is the table showing the ratios of the volume of the gas in the reservoir chamber during production of the lash adjuster to the reference volume, when inner pressure increase upper limit is changed in the condition where the production temperature is 20° C. and the maximum use temperature is 130° C.;

DETAILED DESCRIPTION OF THE EXAMPLE EMBODIMENTS

Hereafter, example embodiments of the invention will be described in detail with reference to accompanying drawings.

Figure 1:
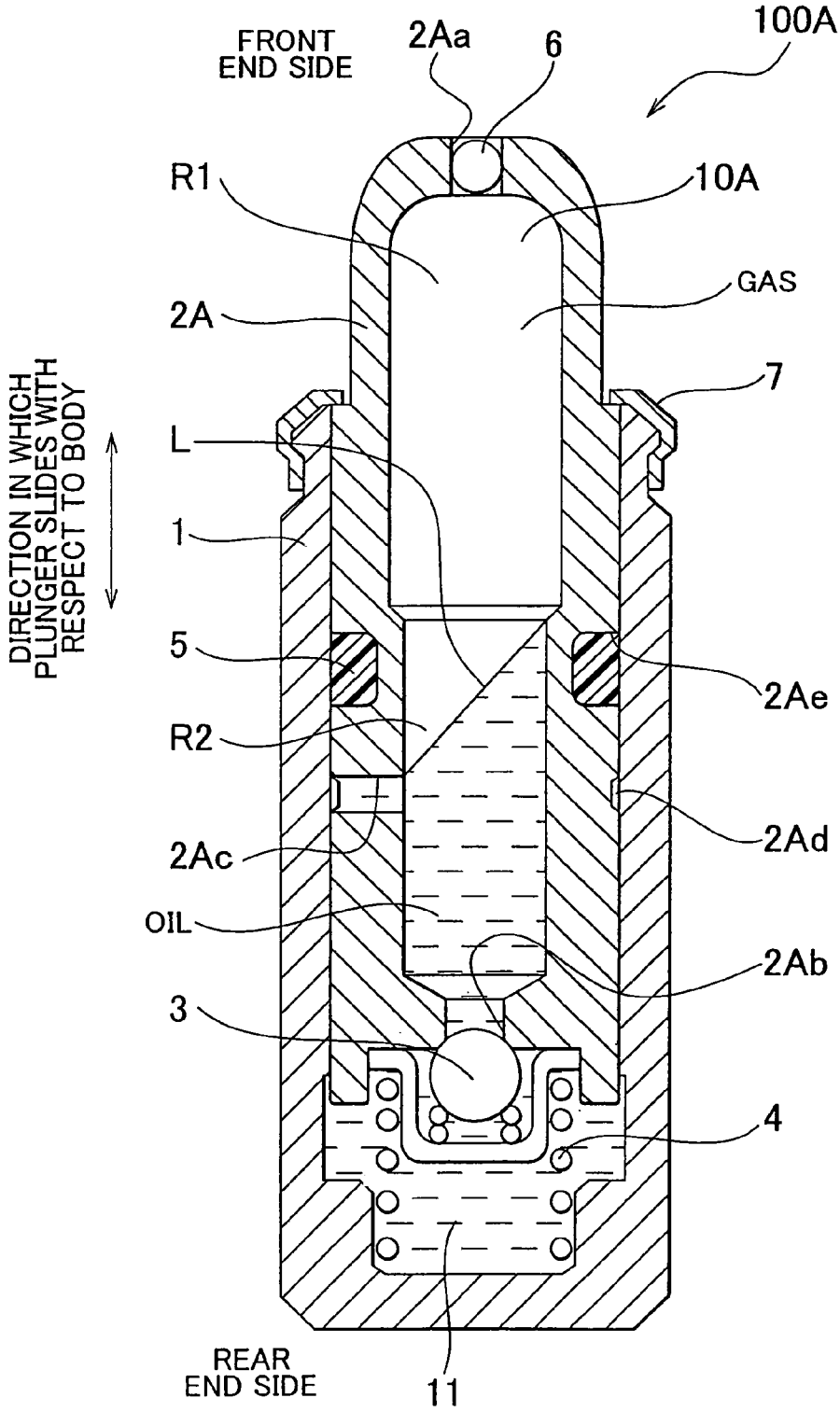
FIG. 1 is the view showing the structure of a lash adjuster 100A according to a first or a fourth embodiment of the invention.

FIG. 1 is the view showing the structure of a sealed lash adjuster (hereinafter, simply referred to as a "lash adjuster") 100A according to a first embodiment of the invention. The lash adjuster 100A includes a body 1, a plunger (a moving member) 2A, a check valve (fluid backflow prevention means) 3, a plunger spring (an elastic member) 4, a seal member 5, a ball plug 6, and a cap retainer 7.

The body 1 is a cylindrical member that is closed at its bottom. The plunger 2A is housed in the cylindrical body 1 so as to be slidable in the axial direction of the lash adjuster 100A. The cap retainer 7, which prevents excessive protrusion of the plunger 2A from the body 1, is arranged at the front end portion of the body 1. The plunger 2A is a cylindrical member, and a reservoir chamber 10A is formed in the plunger 2A. A supply hole 2Aa, through which oil (liquid) is supplied into lash adjuster 100A, is formed in the front end portion of the plunger 2A. The ball plug 6, which is used to seal the oil and air (gas) within lash adjuster 100A, is pressed in the supply hole 2Aa. A predetermined amount of oil occupies part of the space in the reservoir chamber 10A. The air obtained from the atmosphere around the lash adjuster 100A during its production (hereinafter, referred to as the "production atmosphere") is present in the remaining space in the reservoir chamber 10A.

A communication hole 2Ab, which provides communication between the reservoir chamber 10A and a high-pressure chamber 11, is formed in the rear end portion of the plunger 2A. In addition, the check valve 3 is arranged at the communication hole 2Ab. The high-pressure chamber 11 is formed on the rear side of the plunger 2A. The plunger spring 4 is arranged in the high-pressure chamber 11. The check valve 3 opens when the plunger spring 4 applies a force to the plunger 2A such that the plunger 2A moves upward. The check valve 3 permits an oil flow only from the reservoir chamber 10A to the high-pressure chamber 11, and prohibits an oil flow from the high-pressure chamber 11 to the reservoir chamber 10A.

A recycle hole (a through hole) 2Ac, which extends from the sliding face of the plunger 2A to the reservoir chamber 10A, is formed in the plunger 2A. The opening portion of the recycle hole 2Ac, which opens into the reservoir chamber 10, is always closer to the high-pressure chamber 11 than an oil level (liquid level) L is (i.e., the opening portion of the recycle hole 2Ac is always below the oil level L) when the lash adjuster 100A is in use. The lash adjuster 100A according to the first embodiment of the invention is fitted to an internal combustion engine (not shown) while being tilted with respect to the plumb line by 45 degrees. Accordingly, the oil level L shown in FIG. 1 is tilted by 45 degrees with respect to the central axis of the lash adjuster 100A.

The recycle hole 2Ac extends toward the central axis so as to be perpendicular to the central axis. A groove portion 2Ad is circumferentially formed in the sliding face of the plunger 2A, at the same level as the recycle hole 2Ac (at the same position as the recycle hole 2Ac in the direction in which the plunger 2A slides with respect to the body 1). In addition, a groove portion 2Ae is circumferentially formed in the sliding face of the plunger 2A, at the position on the front side of the groove portion 2Ad. The seal member 5, which prevents oil leakage to the outside, is fitted in the groove portion 2Ae. The seal member 5 is arranged at the position on the front side of the recycle hole 2Ac, and seals a slight gap between the body 1 and the plunger 2A.

Figure 2:
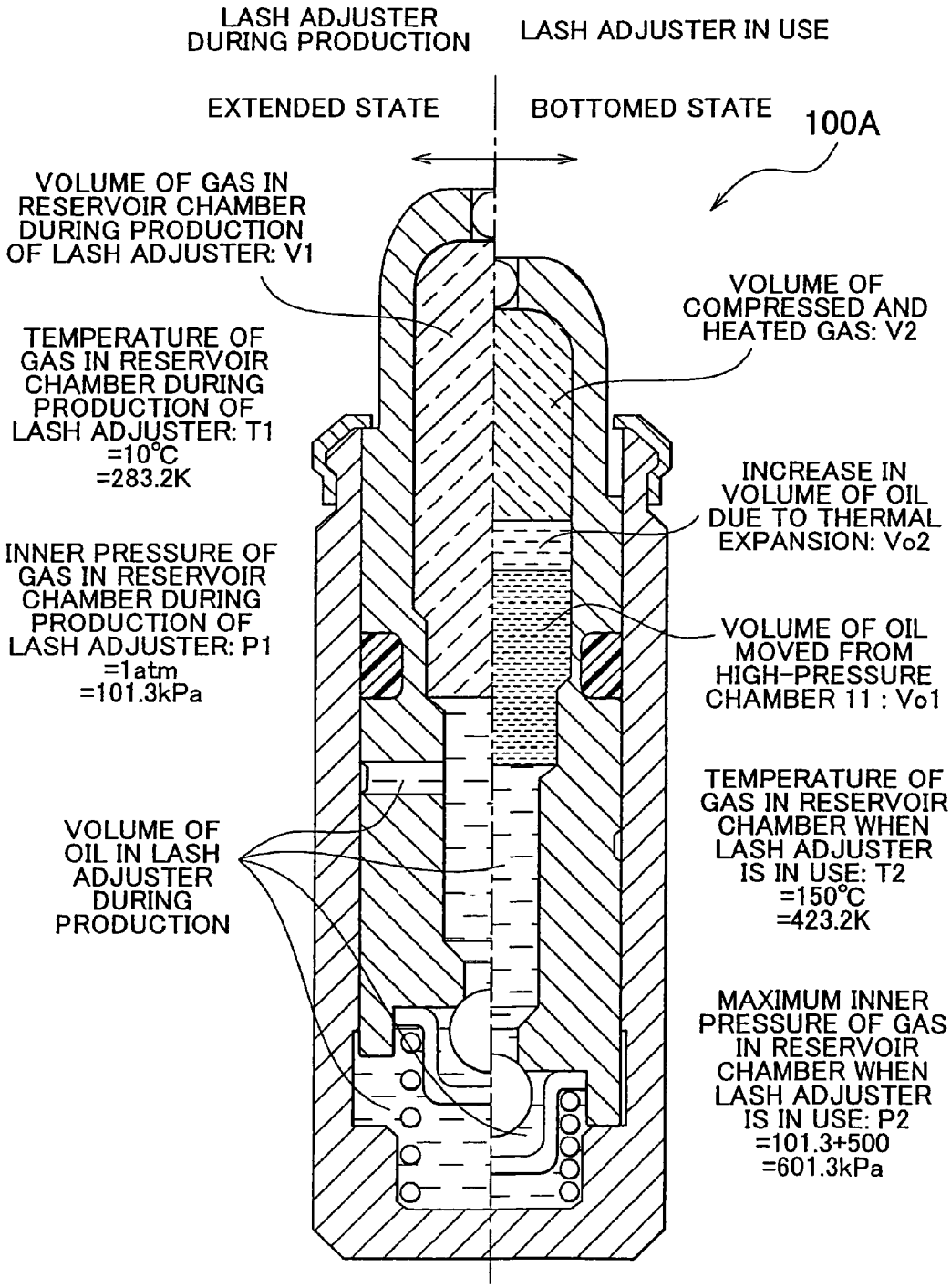
FIG. 2 is the view showing a comparison between the lash adjuster 100A during production, in which a plunger 2A is in the extended state, and the lash adjuster 100A which is in use and in which the plunger 2A is in the bottomed state.

Next, the inner pressure of the lash adjuster 100A having the above-described structure will be described in detail. FIG. 2 is the view showing a comparison between the lash adjuster 100A during its production, in which the plunger 2A protrudes from the body 1 to the fullest extent (hereinafter, this state will be referred to as the "extended state"), and the lash adjuster 100A which is in use and in which the plunger 2A has moved downward to the fullest extent (hereinafter, this state will be referred to as the "bottomed state"). In FIG. 2, the left side with respect to the central axis shows the lash adjuster 100A during its production, in which the plunger 2A is in the extended state. In FIG. 2, the right side with respect to the central axis shows the lash adjuster 100A which is in use and in which the plunger 2A is in the bottomed state. The reference numerals that denote the components of the lash adjuster 100A are not shown in FIG. 2.

As shown on the left side of FIG. 2, the plunger 2A protrudes from the body 1 to the fullest extent (i.e., the plunger 2A is in the extended state) during production of the lash adjuster 100A. The air present in the reservoir chamber 10A is obtained from the production atmosphere. Accordingly, the temperature of the air in the reservoir chamber 10A matches the temperature of the atmosphere present around the lash adjuster 100A during production (hereinafter, referred to as the "production temperature"). Also, the air in the reservoir chamber 100A has the atmospheric pressure. Usually, the production temperature is a value in a range "from 10° C. to 30° C.". The production temperature used in the following examination is set to 10° C. in order to obtain the examination results applicable to all the common production environments. "V1" in FIG. 2 denotes the volume of the gas present in the reservoir chamber 10A during production of the lash adjuster 100A. As described later in detail, the gas in the reservoir chamber 10A is not limiter to air, and the pressure of the gas in the reservoir chamber 10A during production of the lash adjuster 100A is not limited to the atmospheric pressure. Also, the temperature of the gas in the reservoir chamber 10A during production of the lash adjuster 100A is not limited to the temperature of the production atmosphere.

The lash adjuster 100A is applied to the internal combustion engine (not shown). In this use environment, the maximum use temperature of the lash adjuster 100A is a value in a range "from 80° C. to 150° C.". The maximum use temperature used in the following examination is set to 150° C. in order to obtain the examination results applicable to all the common production environments. The right side of FIG. 2 shows the lash adjuster 100A which is in use and in which the plunger 2A has moved downward to the fullest extent (i.e., the plunger 2A is in the "bottomed state") at the temperature of 150° C. The inner pressure of the lash adjuster 100A is the maximum value when the plunger 2A is in the bottomed state. The maximum inner pressure of the lash adjuster 100A should be limited. In the following embodiments, the upper limit of the difference in the inner pressure between the extended state and the bottomed state (hereinafter, referred to as the "inner pressure increase upper limit") is 500 kPa. However, the inner pressure increase upper limit can be lower or upper than 500 kPa. The inner pressure increase upper limit is the upper limit of the increase in the inner pressure with respect to the atmospheric pressure.

When the lash adjuster 100A moves downward, the oil is pushed out of the high-pressure chamber 11 and moves to the reservoir chamber 10A through a slight gap between the body 1 and the plunger 2A, the groove portion 2Ad and the recycle hole 2Ac. "Vo1" in FIG. 2 denotes the volume of the oil, which moves from the high-pressure chamber 11 into the reservoir chamber 10A when the plunger 2A, which has been in the extended state, is brought into the bottomed state. When the temperature of the lash adjuster 100A increases from 10° C. to 150° C., the oil expands. "Vo2" denotes the increase in the volume of the oil due to such expansion. The gas in the reservoir chamber 10A is compressed by the oil moved from the high-pressure chamber 11, and expands due to an increase in the temperature from 10° C. to 150° C. The volume of the compressed and expanded gas is denoted by "V2".

If the volume "V1" of the gas in the reservoir chamber 10A during production of the lash adjuster 100A is "100 $mm^3$", the volume "V2" of the gas when the plunger 2A is in the bottomed state is determined according to Boyle/Charle's law indicated by the equation ($P1 \times V1/T1 = P2 \times V2/T2$). In this equation, "P1" and "T1" are the inner pressure and the temperature of the gas in reservoir chamber 10A during production of the lash adjuster 100A, respectively, and "P2" and "T2" are the maximum inner pressure and the maximum temperature of the gas in the reservoir chamber 10A when the lash adjuster 100A is in use, respectively. Accordingly, "101.3 kPa" is substituted for "P1", "100 $mm^3$" is substituted for "V1", "283.2 K" is substituted for "T1", "601.3 kPa" is substituted for "P2", and "423.2 K" is substituted for "T2". It is thus determined that the volume "V2" of the gas in the reservoir chamber 10A when the lash adjuster 100A is in use is "25.18 $mm^3$".

The relational expression indicated by the equation ($Vo1 + Vo2 = V1 - V2$) is derived based on FIG. 2. When "V2" is "25.18 $mm^3$", "Vo1+Vo2" equals "74.82 $mm^3$". "Vo1+Vo2" is used as the reference volume. "Vo1" is a value specific to the lash adjuster 100A. If the amount of oil sealed in the lash adjuster 100A is fixed, "Vo2" is also a value specific to the lash adjuster 100A, which is determined based on the amount of oil sealed in the lash adjuster 100A and the rate of thermal expansion. Each of the volume "V1" of the gas in the reservoir chamber 10A during production of the lash adjuster 100A and the reference volume "Vo1+Vo2" is divided by "74.82 $mm^3$". If the value obtained by diving the reference volume "Vo1+Vo2" by "74.82 $mm^3$" equals "1", and the value obtained by dividing the volume "V1" of the gas in the reservoir chamber 10A during production of the lash adjuster 100A equals "1.34", the increase in the inner pressure of the lash adjuster 100A is maintained at the inner pressure increase upper limit of 500 kPa. Namely, if the volume "V1" of the gas in reservoir chamber 10A during production of the lash adjuster 100A is equal to or more than "1.34 times" as great as the reference volume "Vo1+Vo2", the increase in the inner pressure of the lash adjuster 100A is maintained at or below the inner pressure increase upper limit of 500 kPa.

The examination described above is made on the preconditions that the examination results applicable to all the common production environments and use environments are obtained. However, if the production environment and the use environment are specified in more detail, the volume "V1" of the gas in the reservoir chamber 10A during production of the lash adjuster 100A may be reduced, which makes it possible to reduce the size of the lash adjuster 100A. For example, if the production temperature is always higher than "20° C." and the use temperature is always lower than "130° C.", these values are substituted for "T1" and "T2" in the equation indicating Boyle/Charle's law described above. If the volume "V1" of the gas in the reservoir chamber 10A during production of the lash adjuster 100A is equal to or more than "1.30 times" as great as the reference volume "Vo1+Vo2", it can be determined that the increase in the inner pressure of the lash adjuster 100A is maintained at or below the inner pressure increase upper limit of 500 kPa. Namely, under this condition, the increase in the inner pressure of the lash adjuster 100A is maintained at or below the inner pressure increase upper limit of 500 kPa in the more compact lash adjuster 100A.

Similarly, when the production temperature is always higher than "30° C." and the use temperature is always lower than "80° C.", these values are substituted for "T1" and "T2" in the equation indicating Boyle/Charle's law. If the volume "V1" of the gas in the reservoir chamber 10A during production of the lash adjuster 100A is equal to or more than "1.24 times" as great as the reference volume "Vo1+Vo2", it can be determined that the increase in the inner pressure of the lash adjuster 100A is maintained at or below the inner pressure increase upper limit of 500 kPa. Namely, under this condition, the increase in the inner pressure of the lash adjuster 100A is maintained at or below the inner pressure increase upper limit of 500 kPa in the further compact lash adjuster 100A. The production environment that is more advantageous to size reduction of the lash adjuster 100A can be realized, for example, by controlling the temperature of the production atmosphere. Also, if the gas is compressed in order to seal more gas in the lash adjuster 100A as described later, the temperature of the gas to be sealed in the lash adjuster 100A is controlled to realize the condition that is more advantageous to size reduction of the lash adjuster 100A. In this case, the temperature of the gas to be sealed in the lash adjuster 100A is not limited to the common production temperature. The gas having an appropriate temperature may be sealed in the lash adjuster 100A in order to maintain increases in the inner pressure of the lash adjuster 100A at or below the inner pressure increase upper limit in the more compact lash adjuster 100A.

Figure 3:
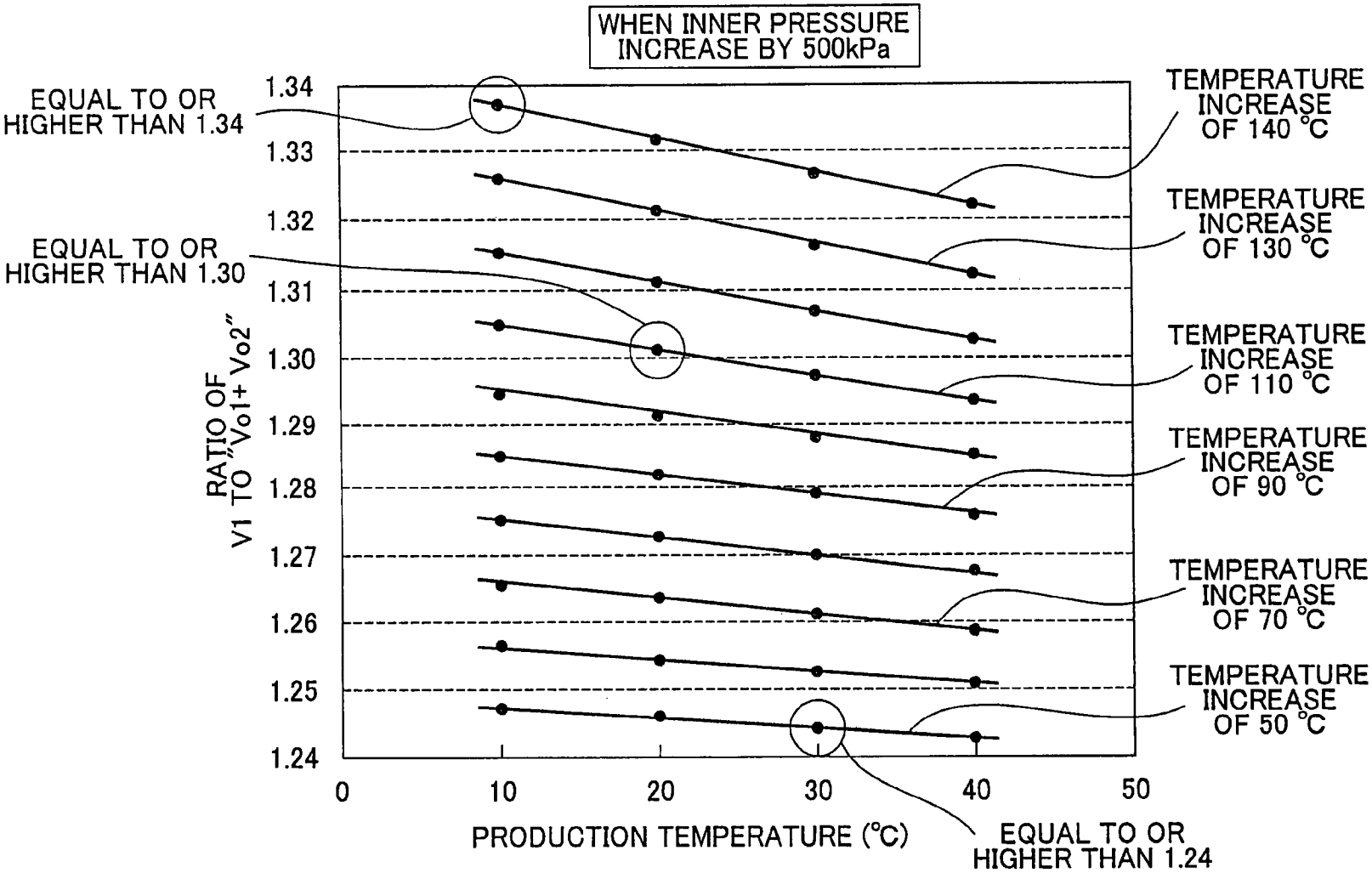
FIG. 3 is the graph showing the temperature range corresponding to the ratio when the inner pressure increases by 500 kPa at maximum.

Next, the temperature range, which corresponds to the ratio of the volume "V1" of the gas in the reservoir chamber 10A during production the lash adjuster 100A to the reference volume "Vo1+Vo2" in the case where the inner pressure of the lash adjuster 100A increases by 500 kPa at maximum, will be described in detail with reference to FIG. 3. In FIG. 3, the vertical axis indicates the ratio of "V1" to "Vo1+Vo2", and the lateral axis indicates the production temperature. In addition, the lines, each indicating the increase in the temperature from the production temperature to the maximum use temperature, are shown in FIG. 3. These lines indicate the increase of 50° C. to the increase of 140° C., respectively, at intervals of 10° C. The temperature range in FIG. 3 is defined by the production temperature and the maximum use temperature. The maximum use temperature is calculated by adding the increase in the temperature to the production temperature indicated in the lateral axis.

The points at which the ratios of "V1" to "Vo1+Vo2" are "1.34", "1.30", and "1.24", respectively, are shown in FIG. 3. As described above, if the ratio of "V1" to "Vo1+Vo2" is equal to or higher than "1.34", "1.30", or "1.24", the increase in the inner pressure of the lash adjuster 100A is maintained at or below 500 kPa under the condition that the production temperature and the maximum use temperature are predetermined values. However, all the ratios of "V1" to "Vo1+Vo2" shown in the vertical axis in FIG. 3 are the values at which the increase in the inner pressure of the lash adjuster 100A is maintained at 500 kPa. These ratios exist in the broad temperature range defined by the production temperature and the maximum use temperature, as shown in FIG. 3. Therefore, under specific production environment and use environment, the oil is sealed in the lash adjuster 100A so that the ratio of "V1" to "Vo1+Vo2", which is derived, from the temperature range corresponding to the ratio shown in FIG. 3, based on the production temperature and the maximum use temperature corresponding to the specific production environment and use environment, is achieved. As a result, the increase in the inner pressure of the lash adjuster 100A is maintained at 500 kPa. If the oil is sealed in the lash adjuster 100A so that a ratio higher than the ratio derived in the above-described manner is achieved, the increase in the inner pressure in the lash adjuster 100A is maintained below 500 kPa.

Figure 4:
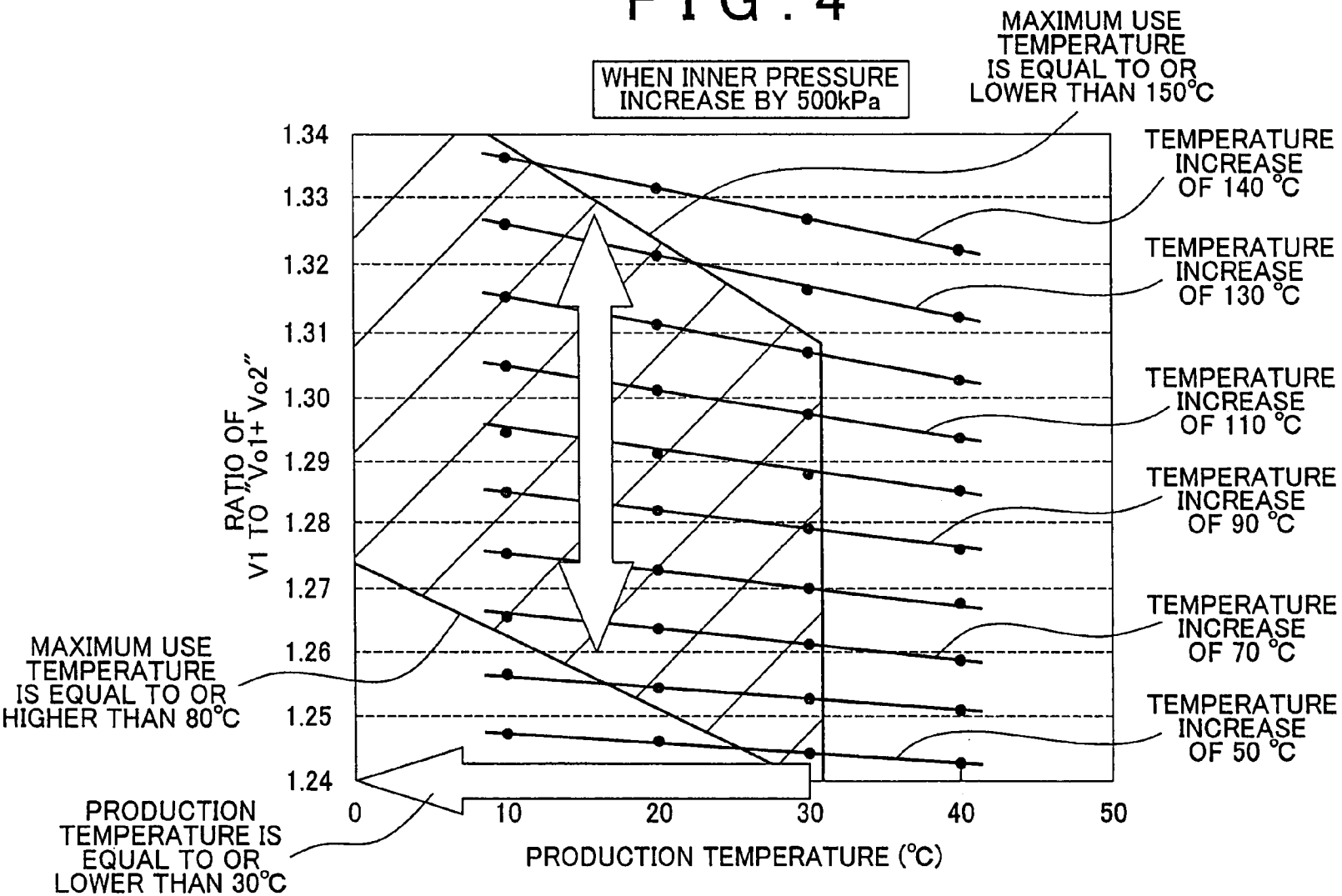
FIG. 4 is the graph showing the temperature range corresponding to the production temperature of 30° C. and lower and the maximum use temperature of 80° C. and higher, the temperature range being part of the temperature range corresponding to the ratio when the inner pressure increases by 500 kPa at maximum.

In FIG. 4, the temperature range corresponding to the common production temperature and maximum use temperature is clearly shown. FIG. 4 clearly shows, using the graph in FIG. 3, the temperature range corresponding to the condition where the production temperature is equal to or lower than 30° C. and the maximum use temperature is equal to or higher than 80° C. The production temperature and maximum use temperature corresponding to the common production environment and use environment are within the range shown in FIG. 4. If the oil is sealed in the lash adjuster 100A so that the ratio derived from the range in FIG. 4 is achieved, the increase in the inner pressure of the lash adjuster 100A is maintained at 500 kPa at the current production temperature and maximum use temperature. If the oil is sealed in the lash adjuster 100A so that a ratio higher than the ratio derived in the above-mentioned manner is achieved, the increase in the inner pressure of the lash adjuster 100A is maintained below 500 kPa at the current production temperature and maximum use temperature.

Figure 5:
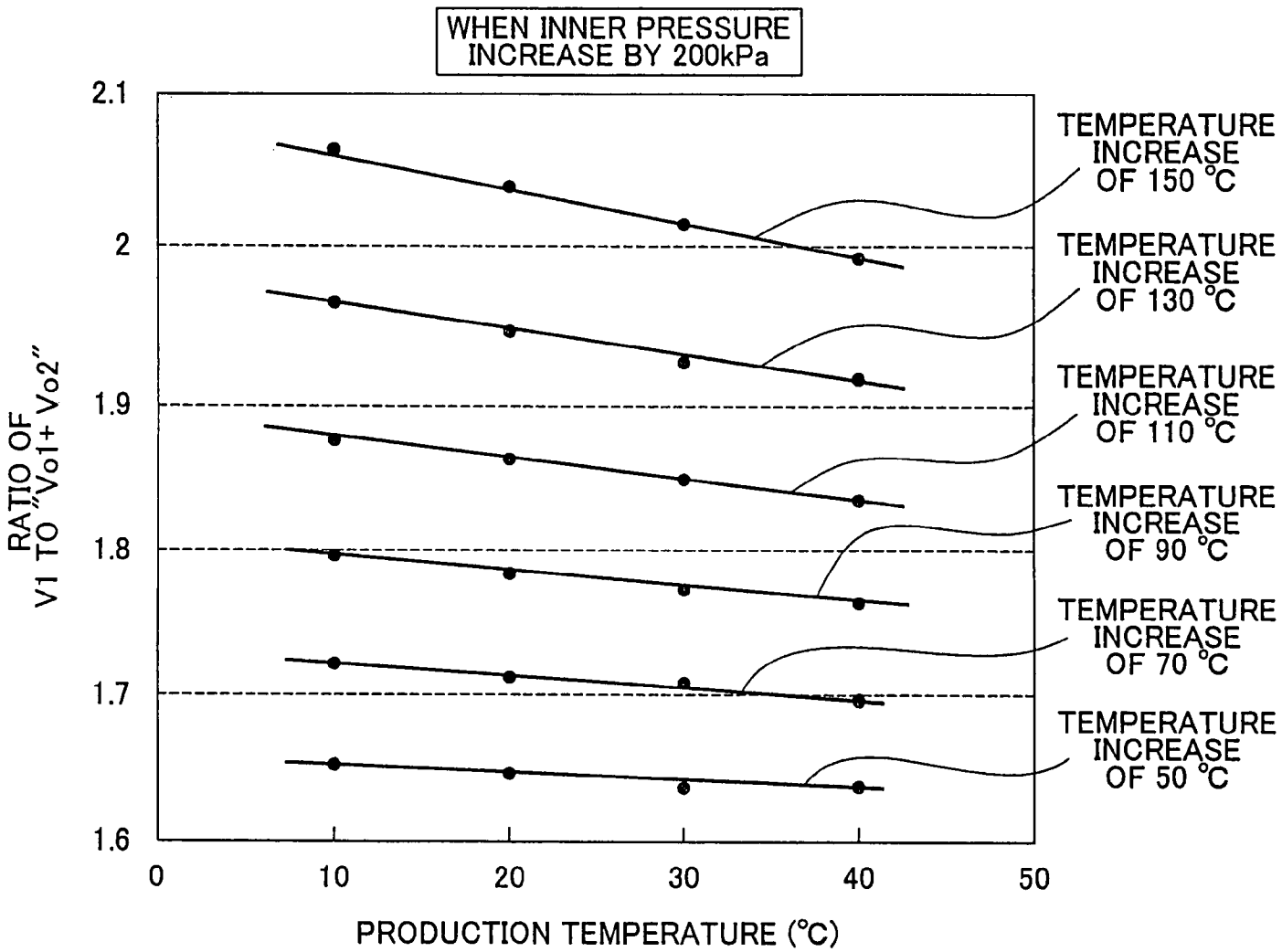
FIG. 5 is the graph showing the temperature range corresponding to the ratio when the inner pressure increases by 200 kPa at maximum.

Next, the case, where the oil is sealed in the lash adjuster 100A so that a ratio higher than the ratio derived in the above-described manner is achieved, will be described in detail. If the increase in the inner pressure is maintained at 200 kPa because the oil is sealed in the lash adjuster 100A so that a ratio higher than the ratio derived in the above-mentioned manner is achieved, the contents of the graph is changed from those in FIG. 4 to those in FIG. 5. A comparison will be made between the graphs shown in FIGS. 4 and 5. FIG. 4 indicates that, if the increase in the inner pressure needs to be maintained at or below 500 kPa when the production temperature is 30° C. and the maximum use temperature is 80° C., the ratio of "V1" to "Vo1+Vo2" should be approximately 1.244 or higher. In contrast, FIG. 5 indicates that, if the increase in the inner pressure can be maintained at 200 kPa, the ratio of "V1" to "Vo1+Vo2" when the production temperature is 30° C. and the maximum use temperature is 80° is approximately 1.65. The same relationship between FIG. 4 and FIG. 5 is established in another temperature range.

Next, with respect to a second embodiment, further examination will be made concerning the temperature. For example, the production temperature may vary depending on the season. Therefore, for example, in summer, the production temperature may exceed 30° C. that is used as the common production temperature. In addition, the production temperature fluctuates even in one day, for example, the production temperature in the morning or evening differs from that in the afternoon. Due to this, the production temperature may exceed 30° C. In some exceptional districts, the lash adjuster 100A may be produced at the production temperature of higher than 30° C. Similarly, the maximum use temperature may exceed the common maximum use temperature. However, the ratio of the volume "V1" of the air in the reservoir chamber 10A during production of the lash adjuster 100A to the reference volume "Vo1+Vo2", at which the increase in the inner pressure is maintained at 500 kPa, depends on the temperature difference ΔT between the production temperature and the maximum use temperature at each production temperature. Based on this, the following correlation is derived.

Figure 6:
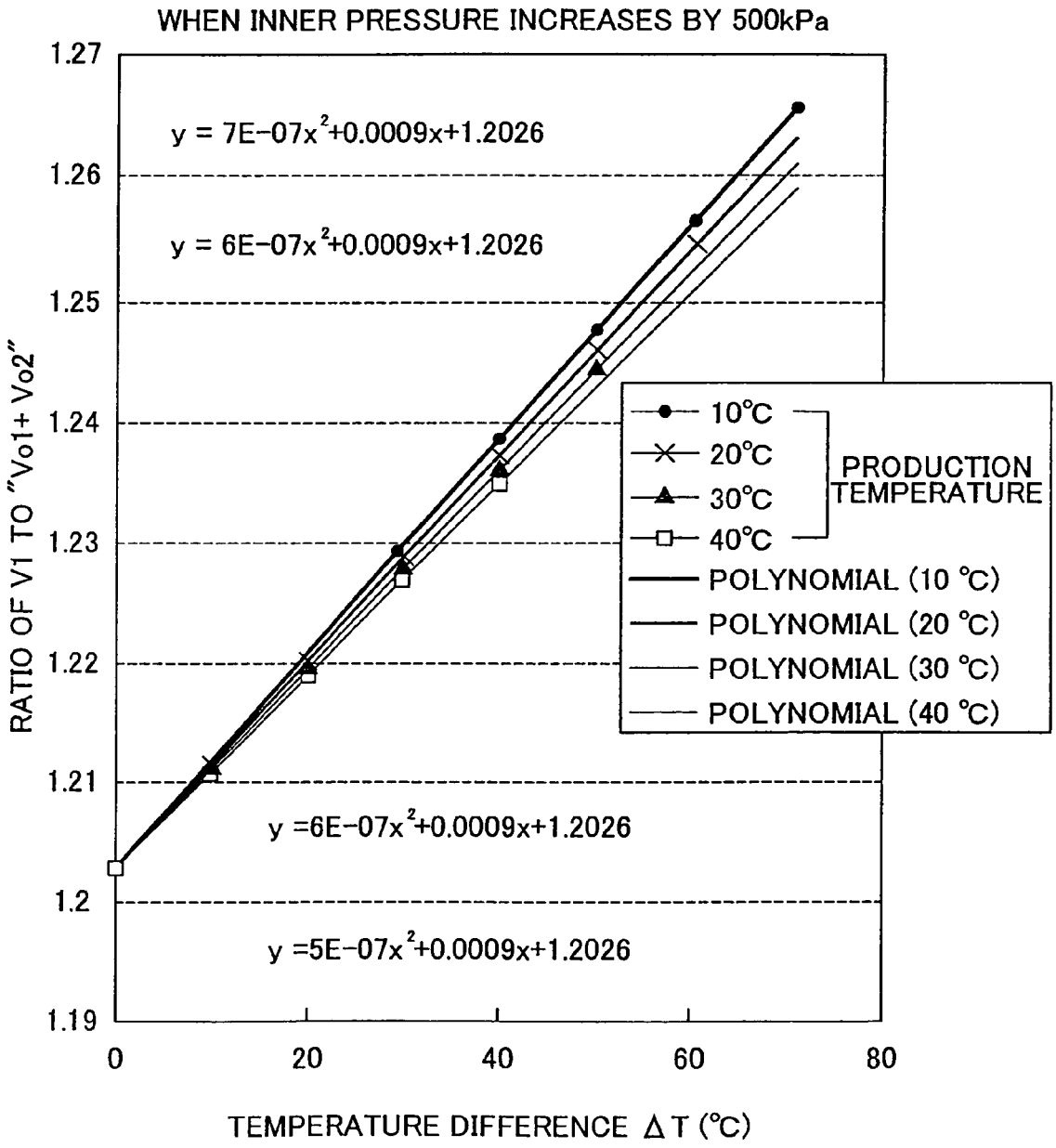
FIG. 6 is the graph showing the relationship between the ratio and the temperature difference $\Delta T$, which is realized when the inner pressure increases by 500 kPa at maximum.

FIG. 6 shows the correlation between the ratio of "V1" to "Vo1+Vo2" and the temperature difference ΔT, which is established when the inner pressure of the lash adjuster 100A increases by 500 kPa. In FIG. 6, the vertical axis indicates the ratio of "V1" to "Vo1+Vo2", and the lateral axis indicates the temperature difference ΔT. In FIG. 6, the range of the temperature difference ΔT shown in the lateral axis is set so that the case, where the maximum use temperature is lower than 80° C. that is used as the common maximum use temperature, is shown. As shown in FIG. 6, the ratio of "V1" to "Vo1+Vo2" is determined based on the temperature difference ΔT according to the polynomial obtained for each production temperature. The polynomial is obtained by plotting multiple ratios corresponding to the respective temperature differences ΔT at a given production temperature and approximating the multiple points by a polynomial method. Based on the above-mentioned correlation, if the oil is sealed in the lash adjuster 100A so that the ratio of "V1" to "Vo1+Vo2", which is derived based on the production temperature and the temperature difference ΔT corresponding to the production environment and the use environment, is achieved, the increase in the inner pressure in the lash adjuster 100A is maintained at 500 kPa. If the oil is sealed in the lash adjuster 100A so that a ratio, which is higher than the ratio derived in the above-mentioned manner, is achieved, the increase in the inner pressure in the lash adjuster 100A is maintained at or below 500 kPa. Thus, the increase in the inner pressure can be maintained at or below 500 kPa, not only in the range where the production temperature and the maximum use temperature are common values but also in the other range, based on the production temperature and the temperature difference ΔT corresponding to the production environment and the use environment.

Figure 7:
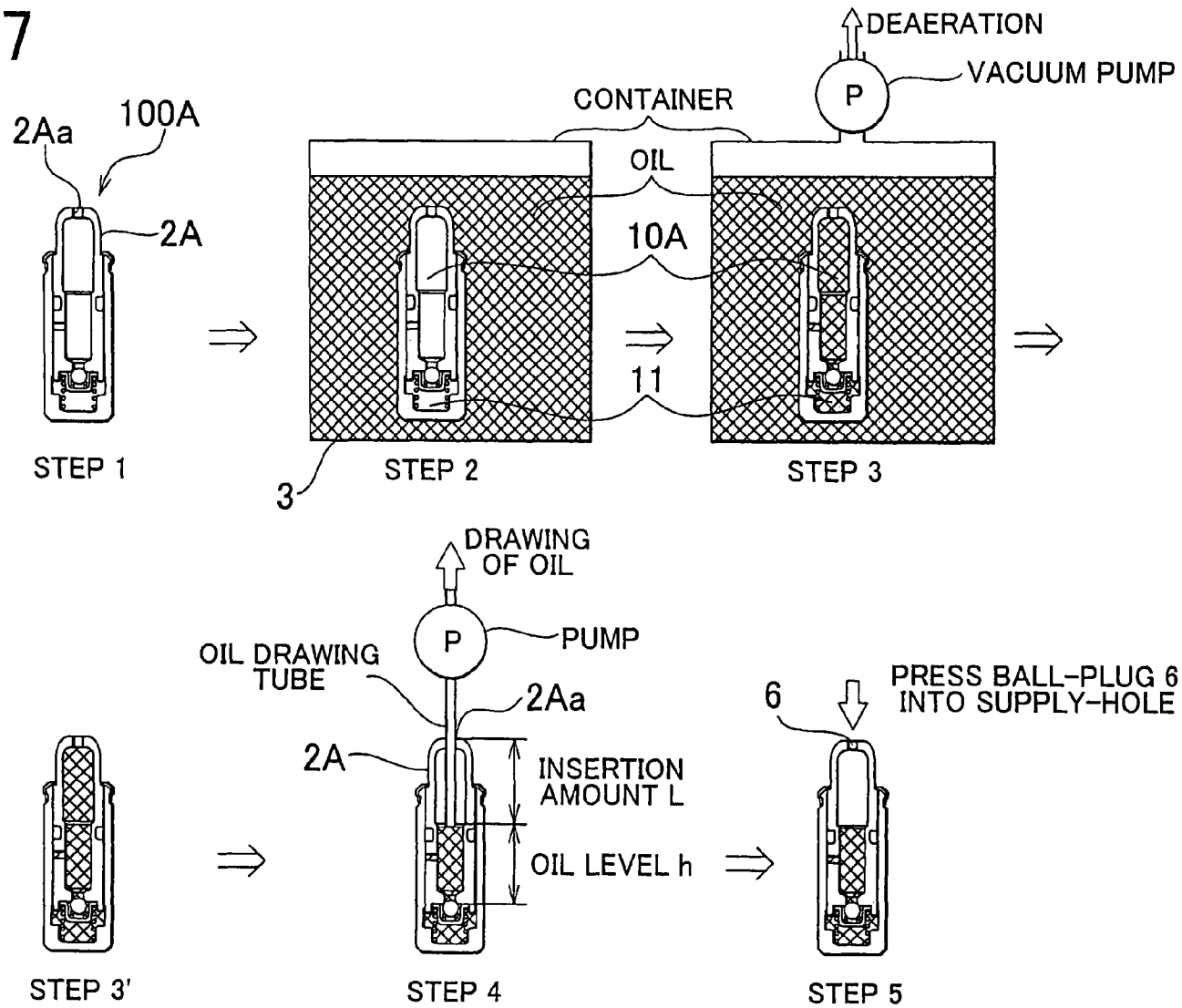
FIG. 7 is the view showing a series of steps for adjusting the amount of oil sealed in the lash adjuster.

Next, with respect to a third embodiment, the method for adjusting the amount of oil sealed in the lash adjuster 100A will be described in detail. FIG. 7 schematically shows a series of steps for adjusting the amount of oil sealed in the lash adjuster 100A. In step 1, the lash adjuster 100A is assembled. In step 1, however, the ball-plug 6 is not yet pressed into the supply hole 2Aa formed in the plunger 2A. In step S2, the lash adjuster 100A is placed in a container containing oil, and immersed in the oil. At this time, the plunger 2A is moved while the check valve 3 is opened by, for example, a dedicated jig. Thus, the high-pressure chamber 11 is temporarily filled with the oil. As a result, the time required to fill the lash adjuster 100 with oil by vacuuming is reduced in step 3 described below. In step 3, the oil is deaerated by a vacuum pump connected to the container, the inner pressure is returned to the atmospheric pressure, and then the lash adjuster 100A is filled with the oil. At this time, the gas in the lash adjuster 100A is also vacuumed by deaeration, and the oil replaces the vacuumed gas. As a result, the reservoir chamber 10A and the high-pressure chamber 11 are filled with oil.

In step 3', the lash adjuster 100A is taken out of the container. In step 4, an oil drawing tube is inserted into the supply hole 2Aa formed in the plunger 2A, and the oil is drawn out of the reservoir chamber 10A until the oil level drops to the predetermined oil level (liquid level) h. The oil level h is determined in the following manner. The appropriate amount of oil should be sealed in the lash adjuster 100A so that the ratio of "V1" to "Vo1+Vo2", at which the increase in the inner pressure is maintained at or below 500 kPa, is achieved. The oil level h is determined so that the amount of oil that should be sealed in the lash adjuster 100A remains in the lash adjuster 100A. When the level h is determined, the ratio of "V1" to "Vo1+Vo2" is derived from, for example, the graph shown in FIG. 4 or FIG. 6 based on the production temperature and the maximum use temperature corresponding to the production environment and the use environment. Thus, the ratio of "V1" to "Vo1+Vo2", at which the increase in the inner pressure is suppressed to or below 500 kPa, is appropriately determined. The amount by which the oil drawing tube is inserted into the plunger 2A is the distance L from the top portion of the plunger 2A. The oil level h is adjusted by adjusting the distance L. Drawing the oil out of the lash adjuster 100A until the oil level drops to the predetermined oil level h makes it possible to appropriately adjust the amount oil sealed in the lash adjuster 100A while the high-pressure chamber 11 is filled with oil, and to prevent the gas from entering the high-pressure chamber 11. In step 5, the ball-plug 6 is pressed into the supply hole 2Aa formed in the plunger 2A, whereby the lash adjuster 100A is sealed. Then, adjustment of the amount of oil sealed in the lash adjuster 100A is completed.

Figure 8:
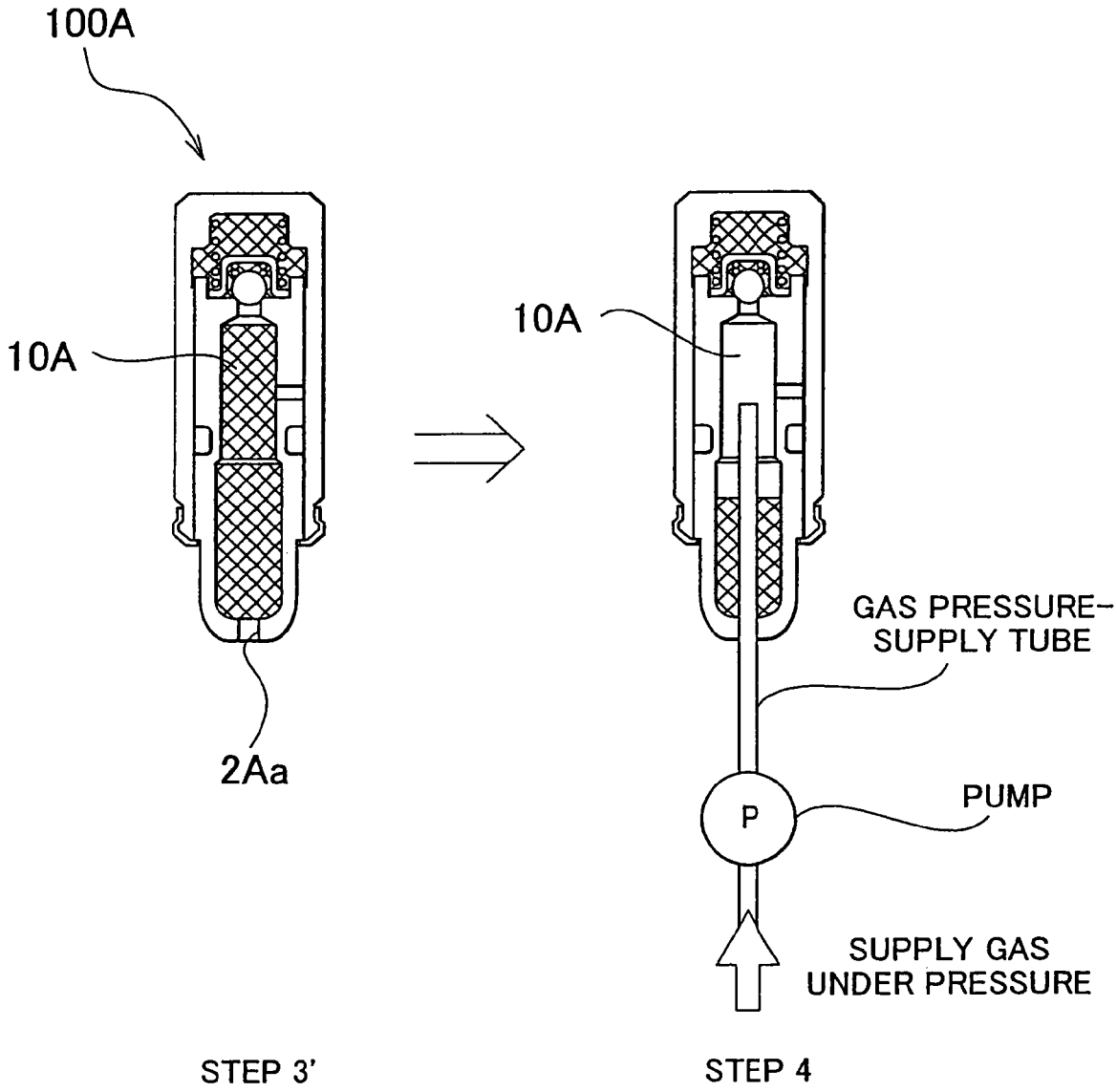
FIG. 8 is the view showing a first modified example realized by modifying step 4 in FIG. 7.

Next, some modified examples of the method for adjusting the amount of oil sealed in the lash adjuster 100A will be described. FIG. 8 is the view showing the first modified example. The first modified example is obtained by modifying step 4 in FIG. 7. In step 3' subsequent to step 3 in the first modified example, the lash adjuster 100A is turned upside down. In step 4, a predetermined amount of gas is supplied, under pressure, into the reservoir chamber 10A through the supply hole 2Aa. When, for example, nitrogen gas, argon gas, or helium gas is sealed in the lash adjuster 100A in order to prevent oxidation degradation of the oil, it is possible to prevent such gas from mixing with the air. The predetermined amount of gas supplied, under pressure, into the reservoir chamber 10A is determined in the manner similar to the manner in which the oil level h is determined. The appropriate amount of oil is sealed in the lash adjuster 100A so that the ratio of "V1" to "Vo1+Vo2", at which the increase in the inner pressure is maintained at or below 500 kPa, is achieved. The predetermined amount of gas supplied into the reservoir chamber 10A is calculated so that the amount of oil that should be sealed in the lash adjuster 100A remains in the lash adjuster 100A.

Figure 9:
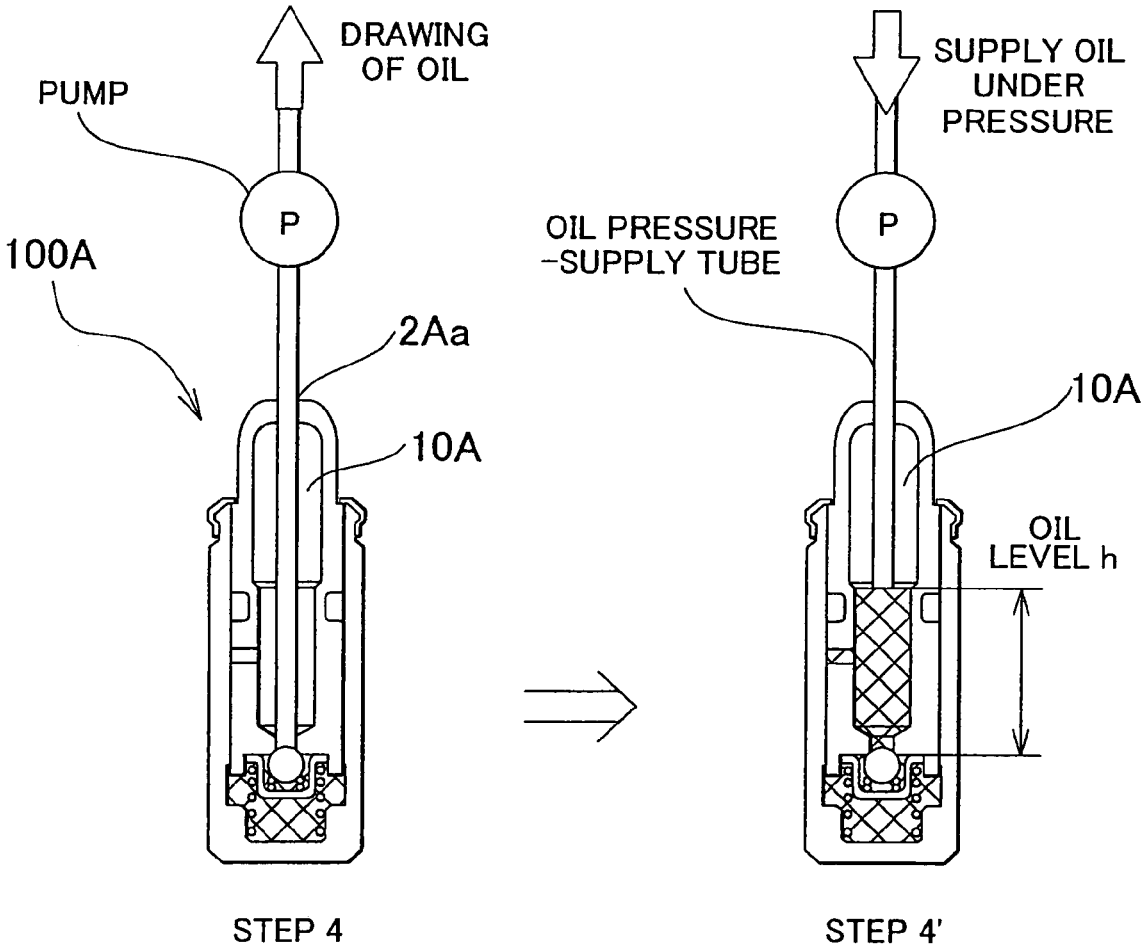
FIG. 9 is the view showing a second modified example realized by modifying step 4 in FIG. 7.

FIG. 9 is the view showing the second modified example. The second modified example is obtained by modifying step 4 shown FIG. 7. In the second modified example, the oil is entirely drawn out of the reservoir chamber 10A through the supply hole 2Aa in step 4. In step S4' subsequent to step 4, a predetermined amount of oil is newly supplied, under pressure, into the reservoir chamber 10A until the oil level increases to the predetermined oil level h. Namely, the amount of oil sealed in the reservoir chamber 10A can be adjusted not only by drawing the oil from the reservoir chamber 10A but also by supplying, under pressure, the oil into the reservoir chamber 10A as in the second modified example.

Figure 10:
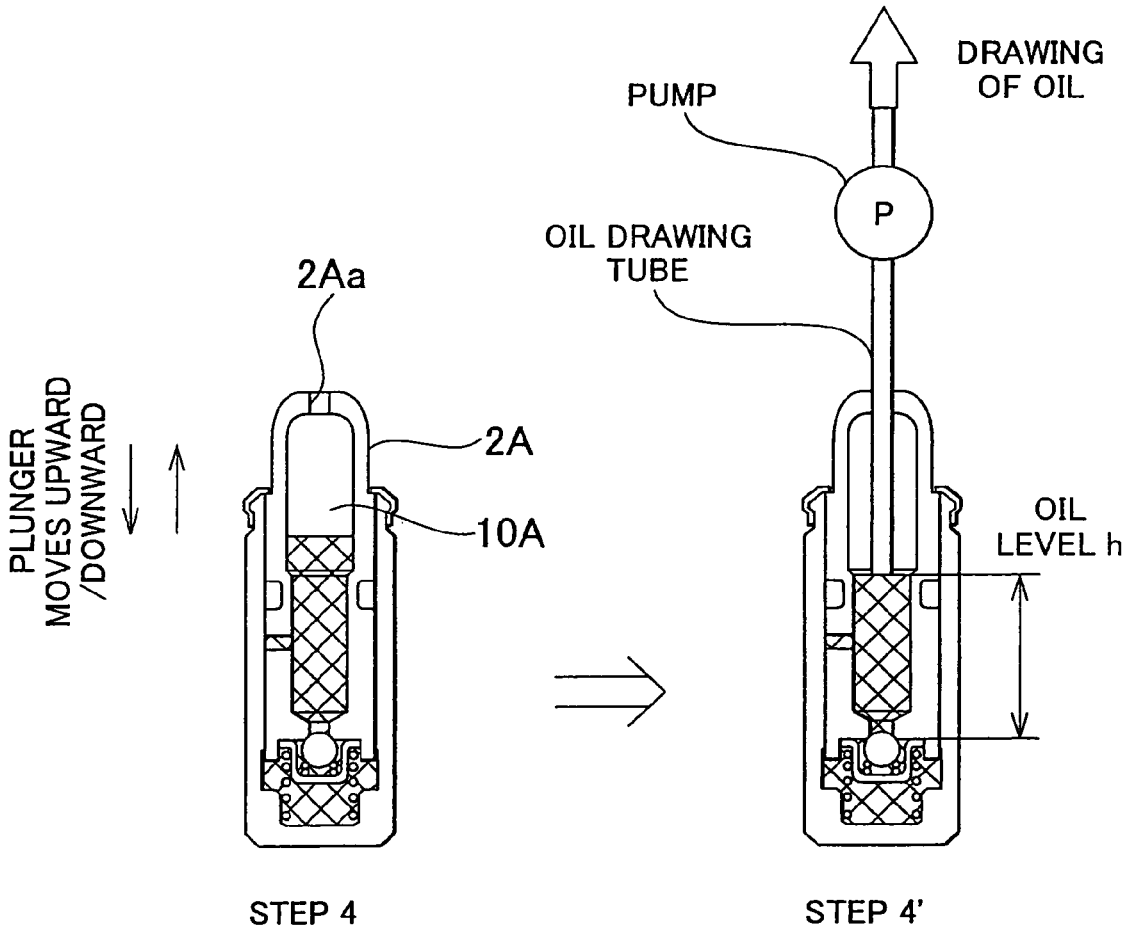
FIG. 10 is the view showing a third modified example realized by modifying step 4 in FIG. 7.

FIG. 10 shows the third modified example. The third modified example is obtained by modifying step 4 in FIG. 7. In the third modified example, in step 4, the plunger 2A is moved downward to the fullest extent (the plunger 2A is brought into the bottomed state), and then moved upward to the fullest extent (the plunger 2A is brought into the extended state). Thus, some oil is discharged from the reservoir chamber 10A by being pressed out of the reservoir chamber 10A through the supply-hole 2Aa formed in the plunger 2A. In step 4' subsequent to step 4, the oil is drawn out of the reservoir chamber 10A until the oil level drops to the predetermined oil level h. Because some oil is discharged, in advance, from the reservoir chamber 10A in step 4, the time required to draw the oil out of the reservoir chamber 10A can be reduced in the third modified example.

Figure 11:
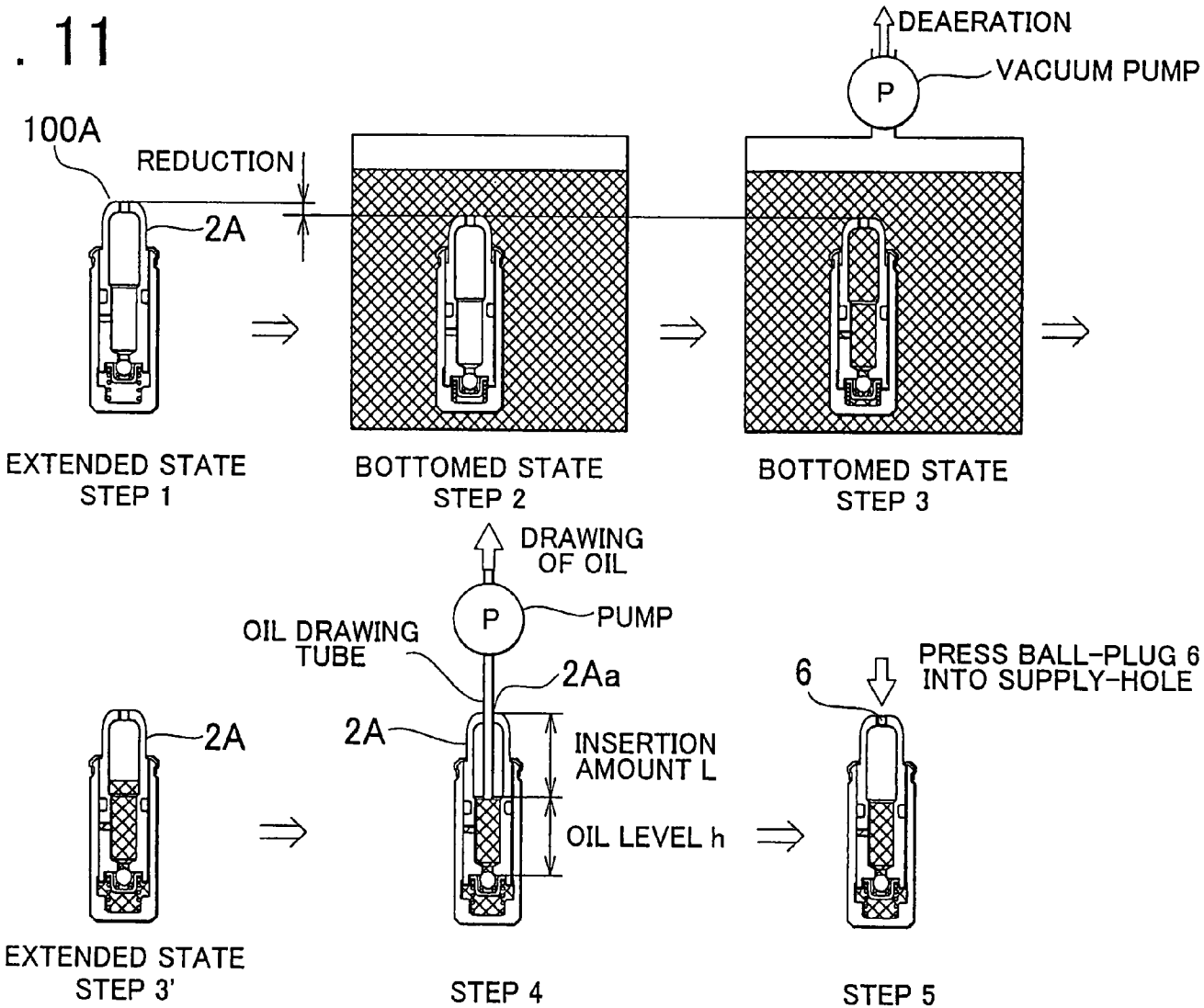
FIG. 11 is the view showing a fourth modified example realized by modifying steps 2, 3 and 3' in FIG. 7.

FIG. 11 shows the fourth modified example. The fourth modified example is obtained by modifying steps 2, 3 and 3' in FIG. 7. In step 1 of the fourth modified example, the lash adjuster 100A is assembled, as in step 1 in FIG. 7. In step 2, the plunger 2A is fixed at the position in the bottomed state, using a dedicated jig, and the lash adjuster 100A is immersed in the oil in the container. In step 3, deaeration is performed and the lash adjuster 100A is filled with oil by vacuuming. In step 3', the lash adjuster 100A is taken out of the container, the jig is removed from the lash adjuster 100A, and the plunger 2A is brought into the extended state. Thus, the time required to draw the oil out of the reservoir chamber 10A can be reduced. Steps 4 and 5 are the same as steps 4 and 5 in FIG. 7. After steps 4 and 5 are completed, adjustment of the amount of oil sealed in the lash adjuster 100A is completed.

For example, in the fourth modified example, the jig may not be removed from the lash adjuster 100A in step 3'. Instead, the jig may be removed from the lash adjuster 100A after the amount of oil sealed in the lash adjuster 100A is adjusted in step 4. In this case, the oil level h needs to be corrected to an oil level appropriate for the lash adjuster 100A in the bottomed state. Alternatively, the jig may not be removed from the lash adjuster 100A in step 4. Instead, the jig may be removed from the lash adjuster 100A after the ball-plug 6 is pressed into the supply-hole 6 in step 5. In this case, foreign matter such as air and water drops may enter the reservoir chamber 10A from the outside of the lash adjuster 100A, because the inner pressure is a negative value in the extended state.

Next, with reference to FIG. 12, description will be made concerning the ratios of the volume of the gas in reservoir chamber 10A during production of the lash adjuster 100A to the reference volume, which should be achieved when the inner pressure increase upper limit is changed under the condition where the production temperature is "20° C." and the maximum use temperature is "130° C.". As described above, if the inner pressure increase upper limit is 500 kPa, the volume of the gas in the reservoir chamber 10A during production of the lash adjuster 100A needs to be "1.30 times" as great as the reference volume. As the inner pressure increase upper limit is decreased, the ratio of the volume of the gas in reservoir chamber 10A during production of the lash adjuster 100A with respect to the reference volume increases. On the other hand, as the inner pressure increase upper limit is increased, the ratio of the volume of the gas in reservoir chamber 10A during production of the lash adjuster 100A with respect to the reference volume decreases. Namely, if the inner pressure is decreased, a less amount of gas will be mixed into the liquid. However, the volume of the gas in the reservoir chamber 10A during production of the lash adjuster 100A needs to be increased, resulting in increases in the size of the lash adjuster 100A. In order to address such inconvenience, the inner pressure is maintained low without increasing its size in the method described below in the lash adjuster 100A.

With reference to FIG. 1, description in the fourth embodiment will be made. As shown in FIG. 1, the reservoir chamber 10A has a region R1 and a region R2. The region R1 and the region R2 have difference cross sectional areas which are defined when the lash adjuster 100A is cut, at positions corresponding to the region R1 and the region R2, by planes perpendicular to the direction in which the plunger 2A slides with respect to the body 1. The cross sectional area of the region R1, which is closer to the front end of the plunger 2A, is greater than the cross sectional area of the region R2. Forming the reservoir chamber 10A having such a shape further increases the volume of the gas in the reservoir chamber 10A during production of the lash adjuster 100A without changing the size of the plunger 2A. Namely, the inner pressure is maintained low without increasing the size of the lash adjuster 100A.

In the lash adjuster 100A, the seal member 5 is arranged at or around the center of the plunger 2A in the direction in which the plunger 2A slides with respect to the body 1. Accordingly, it is possible to minimize the tilt of the plunger 2A with respect to the central axis, which corresponds to the gap between the plunger 2A and the body 1. Thus, reduction in the sealing performance due to partial wear of the seal member 5 can be suppressed. Such shape of the reservoir chamber 10A makes it possible to maintain sufficient thickness of the wall between the region R2 and the sliding face, even if the thickness of the wall is reduced by the amount corresponding to the seal member 5. Namely, employment of such shape of the reservoir chamber 10A makes it possible to maintain the inner pressure of the lash adjuster low without increasing the size of the lash adjuster 100A, and to arrange the seal member 5 at a more appropriate position. In the first embodiment of the invention, the cross section of the reservoir chamber 10A is circular or substantially circular. Preferably, the cross section of the reservoir chamber 10A is circular or substantially circular to facilitate processing. However, the cross section of the reservoir chamber 10A is not limited to a circle/substantial circle. The cross section of the reservoir chamber 10A may be in any shape.

Next, the gas sealed in the lash adjuster 100A will be described in detail. Usually, the gas is the air obtained from the production atmosphere. However, the gas such as nitrogen gas, argon gas, or helium gas may be sealed in the lash adjuster 100A instead of the air. When the gas is the air, the oil may deteriorate due to oxidization. However, if the above-mentioned gas is sealed in the lash adjuster 100A instead of the air, deterioration of the oil is prevented. As a result, increases in the amount of gas mixed into the oil can be suppressed.

Figure 13:
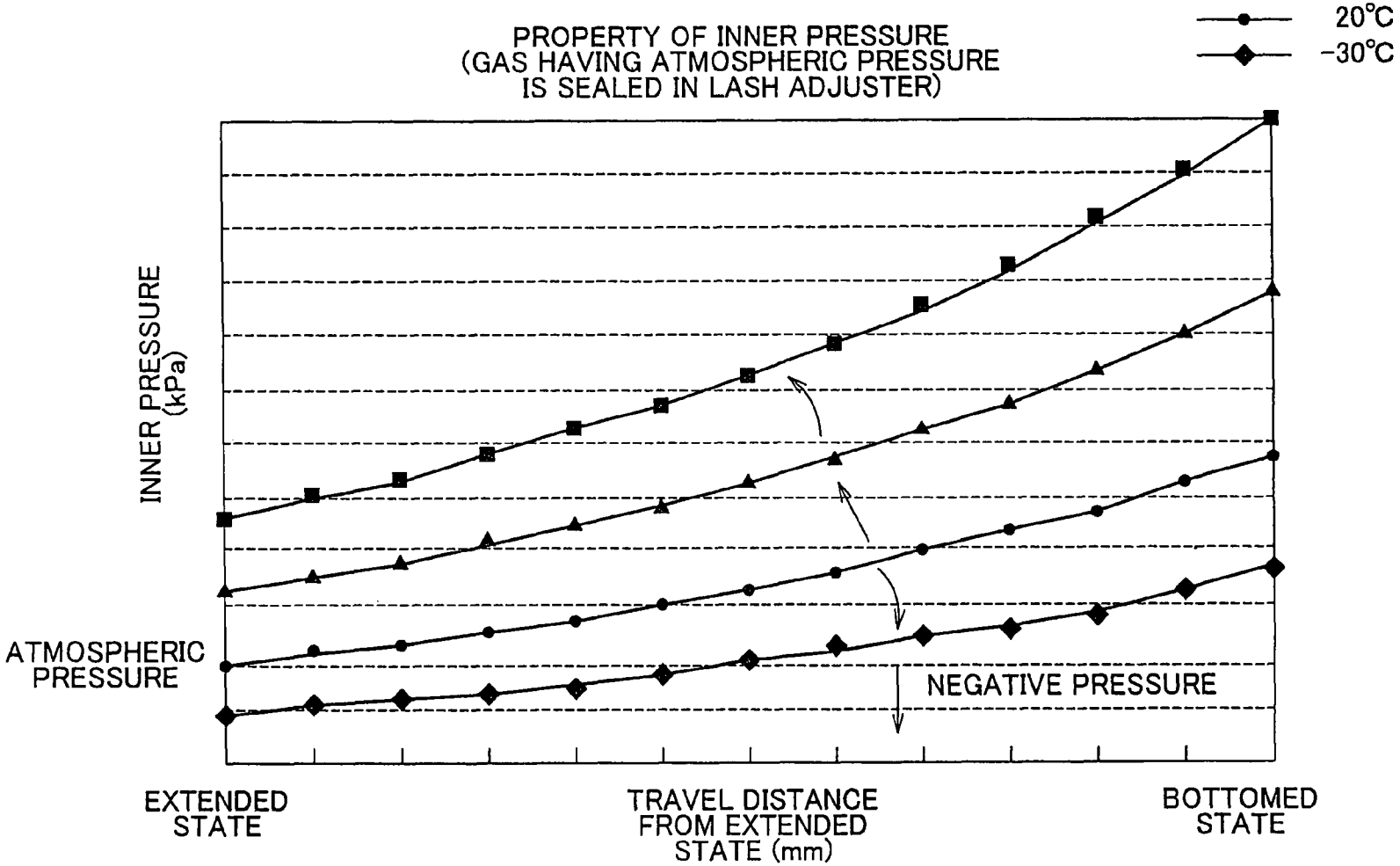
FIG. 13 is the graph showing the relationship between the inner pressure and the position of the plunger 2A, when gas having the atmospheric pressure is sealed in the lash adjuster 100A.
Figure 14:
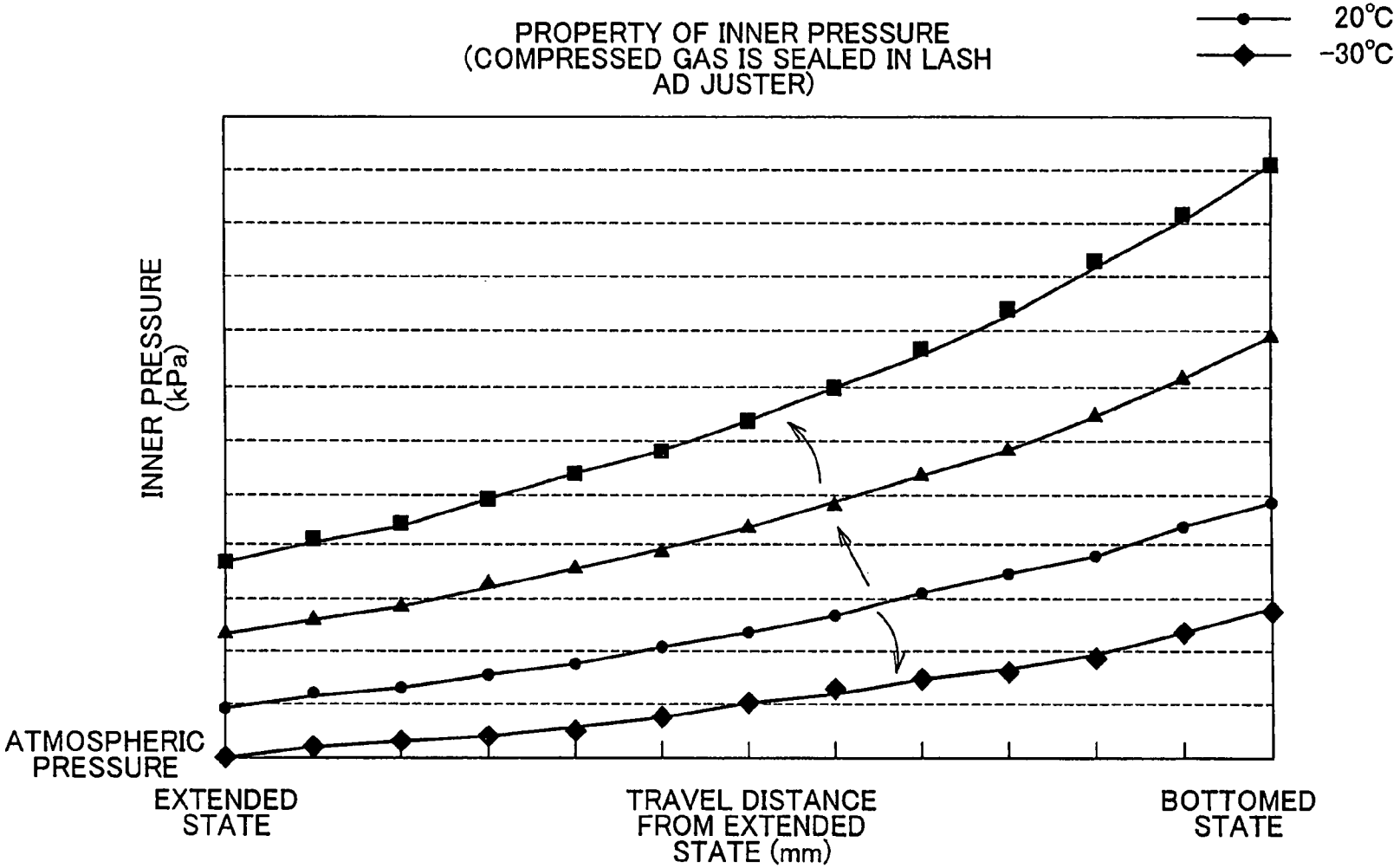
FIG. 14 is the graph showing the relationship between the inner pressure and the position of the plunger 2A, when the pressurized gas is sealed in the lash adjuster 100A.

When the air is sealed in the lash adjuster 100A during its production by the ball plug 6, the lush adjuster 100A contains the gas having the atmospheric pressure and the production temperature. However, the gas, which has been pressurized until the pressure becomes higher than atmospheric pressure, may be sealed in the lash adjuster 100A. The gas may be either the air or the above-mentioned gas. Each of FIGS. 13 and 14 is the graph showing the relationship between the inner pressure of the lash adjuster 100A and the position of the plunger 2A. FIG. 13 is the graph showing this relationship when the gas having the atmospheric pressure is sealed in the lash adjuster 100A. FIG. 14 is the graph showing this relationship when the gas, which has been pressurized until the pressure becomes higher than the atmospheric pressure, is sealed in the lash adjuster 100A.

As shown in FIG. 13, when the gas having the atmospheric pressure is sealed in the lash adjuster 100A at the production temperature of 20° C., the inner pressure of the lash adjuster 100A is the atmospheric pressure when the plunger 2A is in the extended state. As the plunger 2A moves downward, the inner pressure increases, and reaches the maximum value when the plunger 2A is in the bottomed state. When the lash adjuster 100A is used at the temperature of 80° C. or 130° C., the inner pressure of the lash adjuster 100A is higher from when the plunger 2A is in the extended state until when the plunger 2A is in the bottomed state, because the gas and the liquid expand due to the increase in the temperature. On the other hand, if the lash adjuster 100A is used at the temperature of −30° C., for example, in a cold district, the inner pressure of the lash adjuster 100A is a negative value when the plunger 2A is in the extended state.

In contrast, when the gas, which has been pressurized, is sealed in the lash adjuster 100A at the production temperature of 20° C., as shown in FIG. 14, if the lash adjuster 100A is used at the temperature of 80° C. or 130° C., the inner pressure of the lash adjuster 100A is higher because the gas, which has been pressurized, is sealed in the lash adjuster 100A. Also, even if the lash adjuster 100A is used at the temperature of −30° C., the inner pressure of the lash adjuster 100A is maintained at a positive value when the plunger 2A is in the extended state. Thus, it is possible to prevent air, water drops, foreign matter, etc. from entering the lash adjuster 100A from the outside. It is thus possible to provide the lash adjuster 100A and the method for sealing the liquid in the lash adjuster 100A, with which the inner pressure can be maintained low without increasing the size of the lash adjuster 100A. With the lash adjuster 100A and the method for sealing the liquid in the lash adjuster 100A, the inner pressure does not drop to a negative value even when the lash adjuster 100A is used, for example, in a cold district.

Figure 15:
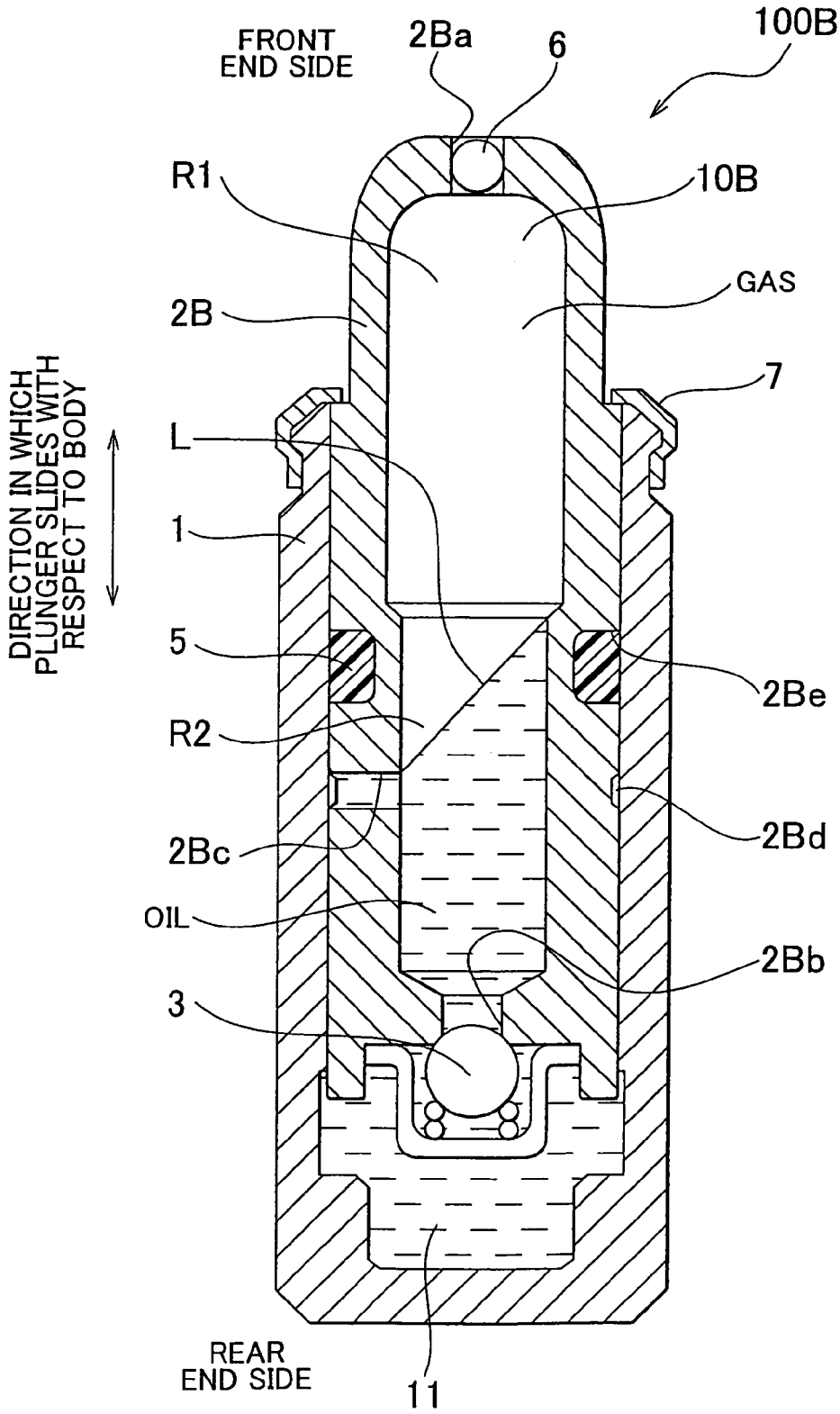
FIG. 15 is the view showing the structure of a lash adjuster 100B according to a first modified example of the fourth embodiment of the invention.

A lash adjuster 100B according to a first modified example of the fourth embodiment of the invention has the same structure as that of the lash adjuster 100A according to the first embodiment of the invention, except that the lash adjuster 100B does not include the plunger spring 4. FIG. 15 is the view showing the structure of the lash adjuster 100B according to the first modified example of the fourth embodiment of the invention. The gas having a pressure higher than the atmospheric pressure is sealed in the lash adjuster 100B during its production, as in the first embodiment of the invention. In this case, appropriately controlling the degree of pressurization of the gas permits the oil having a positive pressure to be reliably present in the high-pressure chamber 11 under the expected use environments. Thus, the pressure in the high-pressure chamber 11 is always higher than the atmospheric pressure. Accordingly, in the lash adjuster 100B, a force can be applied to a plunger 2B so that the plunger 2B moves upward even without the plunger spring 4. The plunger 2B in the first modified example is the same as the plunger 2A in the fourth embodiment. With this structure, the production cost of the lash adjuster is reduced, and flexibility in design of the portion near the check valve 3 is increased. It is thus possible to provide the lash adjuster 100B with which the inner pressure can be maintained low without increasing the size of the lash adjuster 100B. With the lash adjuster 100B, the production cost can be reduced.

Figure 16:
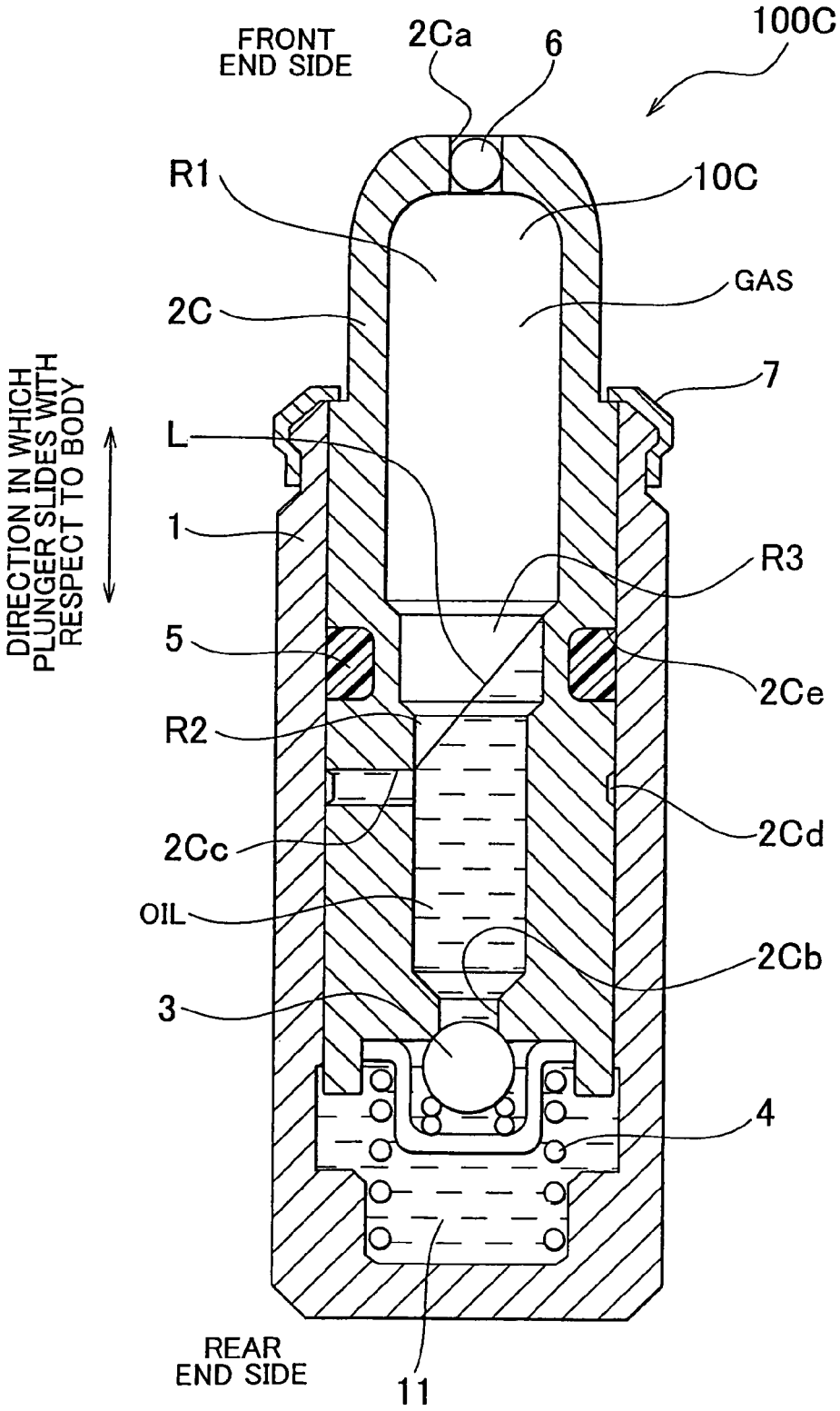
FIG. 16 is the view showing the structure of a lash adjuster 100C according to a second modified example of the fourth embodiment of the invention.
Figure 17A:
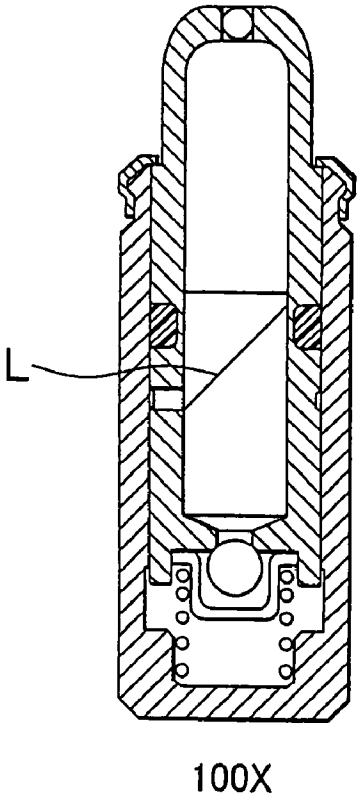
FIG. 17A is the view showing the state of a lash adjuster 100X, in which a reservoir chamber having the same cross sectional area as that of a region R2 in the fourth embodiment is formed, when a plunger is in the extended state.
Figure 17B:
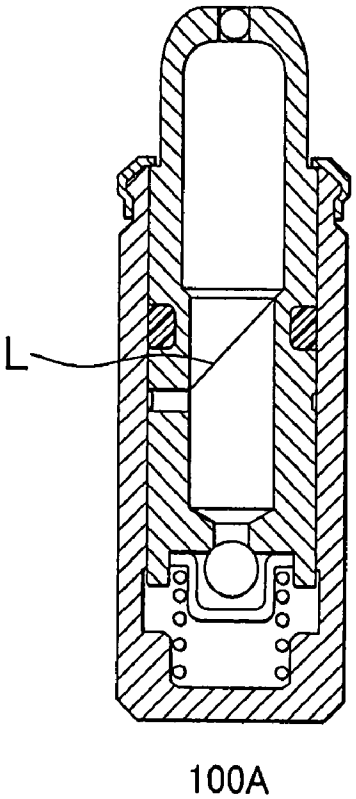
FIG. 17B is the view showing the state of the lash adjuster 100A according to the second modified example of the fourth embodiment, when the plunger 2A is in the extended state.
Figure 17C:
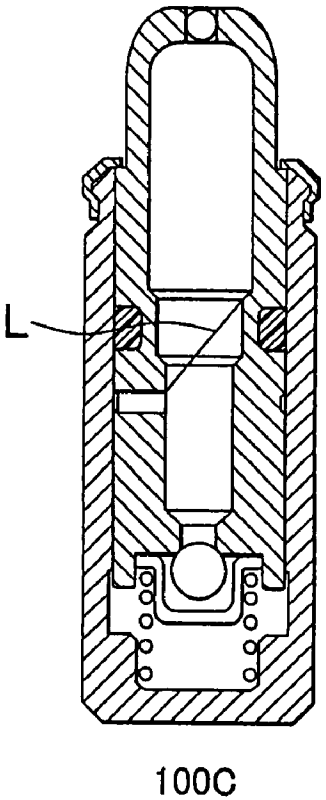
FIG. 17C is the view showing the state of the lash adjuster 100C according to the second modified example of the fourth embodiment, when a plunger 2C is in the extended state.
Figure 17D:
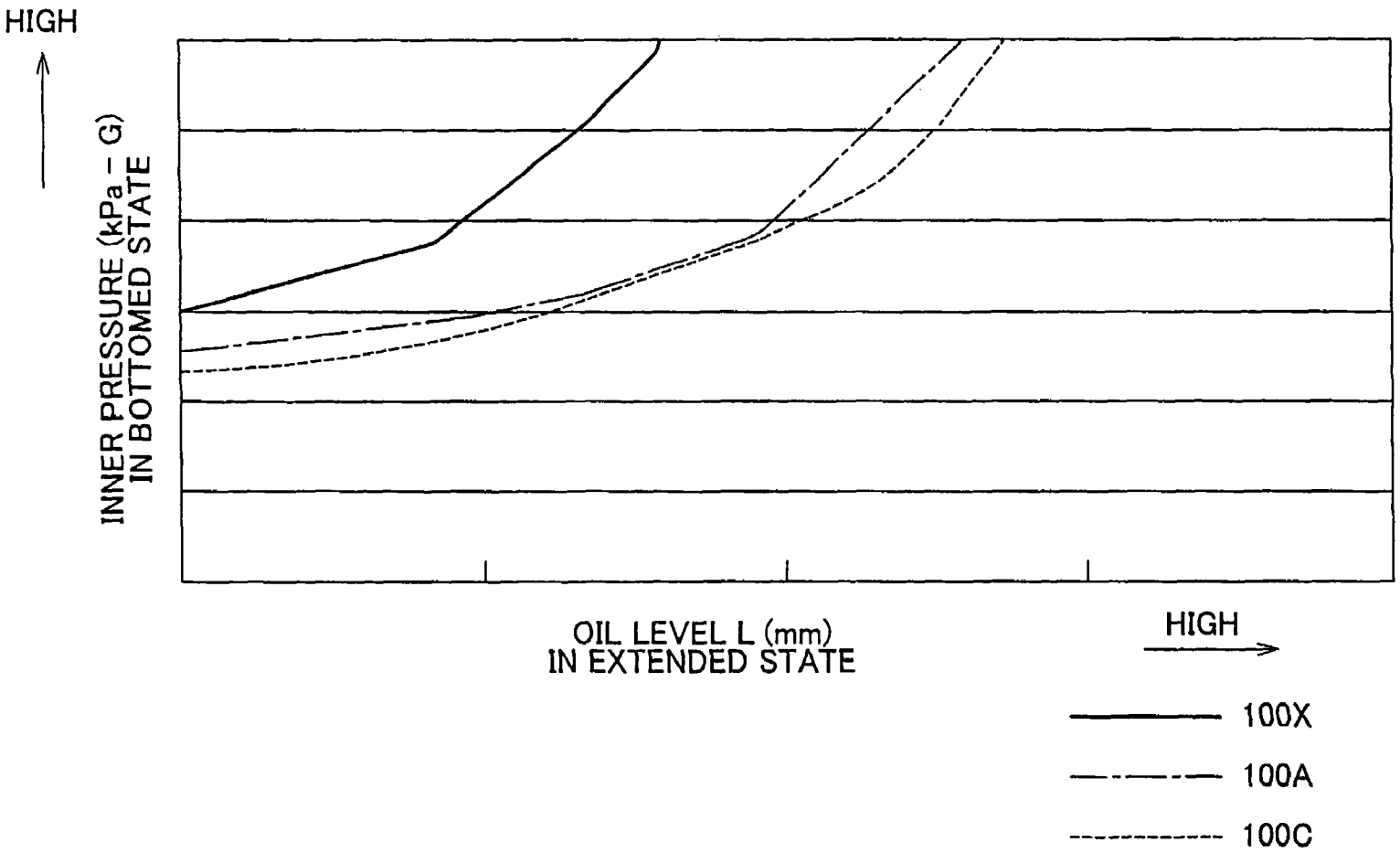
FIG. 17D is the graph showing the relationship between the oil level L when the plunger is in the extended state and the inner pressure when the plunger is in the bottomed state, in each of the lash adjuster 100A, the lash adjuster 100C, and the lash adjuster 100X.

A lash adjuster 100C according to a second modified example of the fourth embodiment of the invention is the same as the lash adjuster 100A according to the fourth embodiment of the invention, except that a plunger 2C is different from the plunger 2A. FIG. 16 shows the structure of the lash adjuster 100C according to the second modified example of the fourth embodiment of the invention. As shown in FIG. 16, a reservoir chamber 10C is formed in the plunger 2C. The reservoir chamber 10C has a region R3 that has the cross section which is greater than that of the region R2 and less than that of the region R1. The region R3 is formed at the position corresponding the seal member 5. Namely, if a required thickness of the wall is maintained even when the seal member 5 is arranged at the same position as that in the lash adjuster 100A according to the fourth embodiment, the shape of the reservoir chamber 10C can be employed. Forming the reservoir chamber 10C further increases the volume of the gas sealed in the lash adjuster 100A during its production. Thus, the inner pressure in the lash adjuster 100C can be further reduced without increasing the size of the lash adjuster 100C. In the second modified example, the cross section of the reservoir chamber 10C is circular or substantially circular. Preferably, the cross section of the reservoir chamber 10C is circular or substantially circular in order to facilitate processing. However, the cross section of the reservoir chamber 10C is not limited to a circle/substantial circle. The cross section of the reservoir chamber 10C may be in any shape.

Next, the relationship between the oil level L when the plunger is in the extended state and the inner pressure of the lash adjuster when the plunger is in the bottomed state will be described. The relationship realized in the lash adjuster 100A, the lash adjuster 100C, and a lash adjuster 100X will be described with reference to FIGS. 17A to 17D. The lash adjuster 100X has the same structure as that of the lash adjuster 100A except that the lash adjuster X includes a plunger 2X in which a reservoir chamber 10X having the same cross sectional area as that of the region R2 is formed.

As shown in FIGS. 17A to 17D, when the oil level L is constant, the inner pressure of the lash adjuster 100C is the lowest, and the inner pressure of the lash adjuster 100X is the highest among the lash adjusters 100A, 100C and 100X. Conversely, if the inner pressure of each of the lash adjusters 100A and 100X is made equal to that of the lash adjuster 100C, the oil level L in the lash adjuster 100A needs to be lower than that in the lash adjuster 100C, and the oil level L in the lash adjuster 100X needs to be lower than that in the lash adjuster 100A in order to maintain the constant volume of the gas in the reservoir chamber during production of the lash adjuster without changing the shape of each reservoir chambers 10. In other words, at the constant inner pressure, the oil level L in the lash adjuster 100A may be higher than that in the lash adjuster 100X, and the oil level L in the lash adjuster 100C may be higher than that in the lash adjuster 100A.

Namely, even when the oil levels L in the lash adjusters 100X and 100A are below recycle holes 2Xc and 2Ac, respectively, the oil level L in the lash adjuster 100C is maintained above the recycle hole 2Cc. The recycle holes 2Ac, 2Cc and 2Xc have the same shape and are formed at the same position. Thus, the recycle hole 2Cc is always below the oil level L in the use environment. As a result, it is possible to prevent the gas from mixing into the oil. It is thus possible to provide the lash adjuster 100C with which the inner pressure can be maintained low without increasing the size of the lash adjuster 100C. With the lash adjuster 100C, it is possible to prevent the gas from mixing into the oil.

Figure 18:
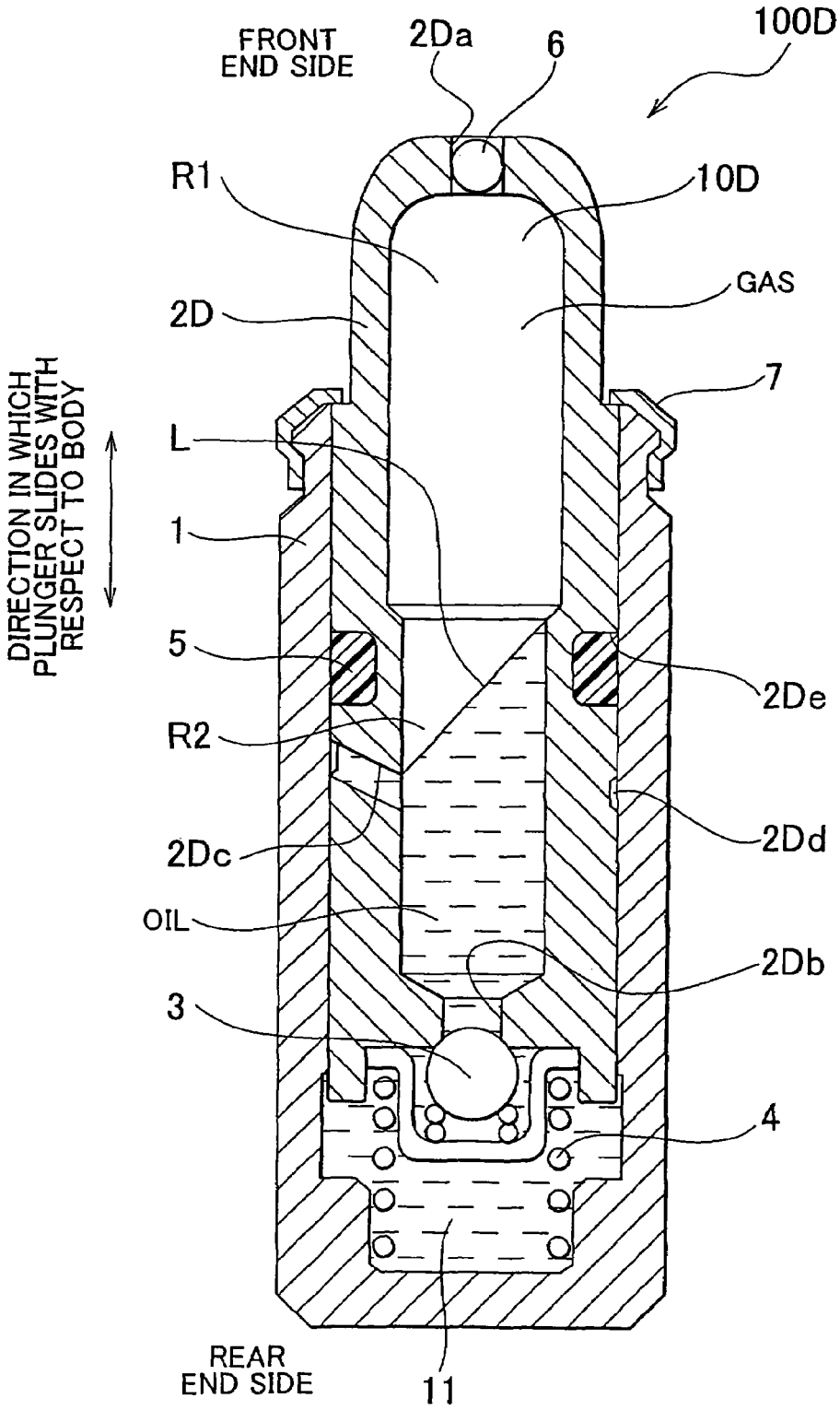
FIG. 18 is the view showing the structure of a lash adjuster 100D according to a third modified example of the fourth embodiment of the invention.

A lash adjuster 100D according to a third modified example of the fourth embodiment of the invention has the same structure as that of the lash adjuster 100A according to the fourth embodiment of the invention except that a plunger 2D is different from the plunger 2A. FIG. 18 is the view showing the structure of the lash adjuster 100D according to the third modified example of the fourth embodiment of the invention. In the lash adjuster 100D, a recycle hole 2Dc is obliquely formed in the plunger 2D such that one opening portion of the recycle hole 2Dc that opens into the reservoir chamber 10D is closer to the high-pressure chamber 11 than the other opening portion that opens at the sliding face is. The reservoir chamber 10D is the same as the reservoir chamber 10A. With this structure, the problem of the lash adjuster 100A that the oil level L may be slightly below the recycle hole 2Ac can be avoided. With the lash adjuster 100D according to the third modified example, the recycle hole 2Dc is always below the oil level L in the use environment, as shown in FIG. 18. As a result, it is possible to prevent the gas from mixing into the oil. It is thus possible to provide the lash adjuster 100D with which the inner pressure can be maintained low without increasing the size of the lash adjuster 100D. With the lash adjuster 100D, it is possible to prevent the gas from mixing into the oil.

The example embodiments of the invention have been described so far. However, the invention is not limited to the example embodiments described above. To the contrary, the invention is intended to cover various modifications and equivalent arrangements.

The invention claimed is:

1. A sealed lash adjuster, comprising:

a moving member that has a reservoir chamber filled with liquid and gas, a through-hole that extends from a sliding face of the moving member to the reservoir chamber, and a communication hole that is formed in a high-pressure-chamber-side end portion of the moving member and that permits communication between the reservoir chamber and a high-pressure chamber;

a body in which the moving member is slidably housed;

a fluid backflow prevention member arranged in the communication hole; and a force-applying member that is arranged in the high-pressure chamber and that applies a force to the moving member to promote protrusion of the moving member from the body, wherein the liquid is sealed in the lash adjuster so that a volume of the gas, which is present in the reservoir chamber when the lash adjuster is being produced and the moving member protrudes from the body to a fullest extent, is equal to or more than 1.24 times as great as a sum of a volume of liquid, that is discharged from the high-pressure chamber when the moving member, which has protruded from the body to the fullest extent, is moved downward to a fullest extent, and an increase in a volume of the liquid which expands, due to heat, when a temperature of the gas in the reservoir chamber changes from a production temperature that is realized when the lash adjuster is being produced to a maximum use temperature that is realized when the lash adjuster is in use; and so that a ratio of the volume of the gas present in the reservoir chamber during production of the lash adjuster to the sum is equal to or higher than a ratio that is derived, based on the production temperature and the maximum use temperature corresponding to a production environment and a use environment, from a temperature range defined by the production temperature and the maximum use temperature, which corresponds to the ratio of the volume of the gas present in the reservoir chamber during production of the lash adjuster to the sum when an inner pressure of the lash adjuster increases by 500 kPa at maximum.

2. The sealed lash adjuster according to claim 1, wherein the temperature range is defined by the production temperature of 30° C. and lower and the maximum use temperature of 80° C. and higher.

3. The sealed lash adjuster according to claim 1, wherein the force-applying member is an elastic member arranged in the high-pressure chamber.

4. A sealed lash adjuster, comprising:

a moving member that has a reservoir chamber filled with liquid and gas, a through-hole that extends from a sliding face of the moving member to the reservoir chamber, and a communication hole that is formed in a high-pressure-chamber-side end portion of the moving member and that permits communication between the reservoir chamber and a high-pressure chamber;

a body in which the moving member is slidably housed;

a fluid backflow prevention member arranged in the communication hole; and a force-applying member that is arranged in the high-pressure chamber and that applies a force to the moving member to promote protrusion of the moving member from the body, wherein the liquid is sealed in the lash adjuster so that a ratio of a volume of the gas, which is present in the reservoir chamber when the lash adjuster is being produced and the moving member protrudes from the body to a fullest extent, to a sum of a volume of liquid, that is discharged from the high-pressure chamber when the moving member, which has protruded from the body to the fullest extent, is moved downward to a fullest extent, and an increase in a volume of the liquid which expands, due to heat, when a temperature of the gas in the reservoir chamber changes from a production temperature that is realized when the lash adjuster is being produced to a maximum use temperature that is realized when the lash adjuster is in use is equal to or higher than a ratio that is derived, based on the production temperature and a temperature difference between the production temperature and the maximum use temperature which correspond to a production environment and a use environment, using a correlation established between the temperature difference and the ratio of the volume of the gas present in the reservoir chamber during production of the lash adjuster to the sum when an inner pressure of the lash adjuster increases by an inner pressure increase upper limit.

5. The sealed lash adjuster according to claim 4, wherein the inner pressure increase upper limit is 500 kPa at maximum.

6. The sealed lash adjuster according to claim 4, wherein the force-applying member is an elastic member arranged in the high-pressure chamber.

7. A method for adjusting an amount of liquid sealed in a sealed lash adjuster including a moving member that has a reservoir chamber filled with liquid and gas, a through-hole that extends from a sliding face of the moving member to the reservoir chamber, and a communication hole that is formed in a high-pressure-chamber-side end portion of the moving member and that permits communication between the reservoir chamber and a high-pressure chamber; a body in which the moving member is slidably housed; a fluid backflow prevention member arranged in the communication hole; and a force-applying member that is arranged in the high-pressure chamber and that applies a force to the moving member to promote protrusion of the moving member from the body, comprising:

adjusting an amount of liquid sealed in the reservoir chamber so that a ratio of a volume of the gas, which is present in the reservoir chamber when the lash adjuster is being produced and the moving member protrudes from the body to a fullest extent, to a sum of a volume of liquid, that is discharged from the high-pressure chamber when the moving member, which has protruded from the body to the fullest extent, is moved downward to a fullest extent, and an increase in a volume of the liquid which expands, due to heat, when a temperature of the gas in the reservoir chamber changes from a production temperature that is fullest extent, and an increase in a volume of the liquid which expands, due to heat, when a temperature of the gas in the reservoir chamber changes from a production temperature that is realized when the lash adjuster is being produced to a maximum use temperature that is realized when the lash adjuster is in use is equal to or higher than a ratio that is derived, based on the production temperature and the maximum use temperature corresponding to a production environment and a use environment, from a temperature range defined by the production temperature and the maximum use temperature, which corresponds to the ratio of the volume of the gas present in the reservoir chamber during production of the lash adjuster to the sum when an inner pressure of the lash adjuster increases by 500 kPa at maximum, or equal to or higher than a ratio that is derived, based on the production temperature and a temperature difference between the production temperature and the maximum use temperature which correspond to the production environment and the use environment, using a correlation established between the temperature difference and the ratio of the volume of the gas present in the reservoir chamber during production of the lash adjuster to the sum when the inner pressure of the lash adjuster increases by an inner pressure increase upper limit.

8. The method for adjusting an amount of liquid sealed in a sealed lash adjuster according to claim 7, wherein the temperature range is defined by the production temperature of 30° C. and lower and the maximum use temperature of 80° C. and higher.

9. The method for adjusting an amount of liquid sealed in a sealed lash adjuster according to claim 7, wherein the inner pressure increase upper limit is 500 kPa at maximum.

10. The method for adjusting an amount of liquid sealed in a sealed lash adjuster according to claim 7, wherein the force-applying member is an elastic member arranged in the high-pressure chamber.

11. A sealed lash adjuster, comprising:

a moving member that has a reservoir chamber filled with liquid and gas, a through-hole that extends from a sliding face of the moving member to the reservoir chamber, and a communication hole that is formed in a high-pressure-chamber-side end portion of the moving member and that permits communication between the reservoir chamber and a high-pressure chamber;

a body in which the moving member is slidably housed;

a fluid backflow prevention member arranged in the communication hole; and an area of a cross section of a first region of the reservoir chamber, the first region being present at a first distance from the communication hole, is greater than an area of a cross section of a second region of the reservoir chamber, the second region being present at a second distance, that is shorter than the first distance, from the communication hole, the said cross sections being perpendicular to a line extending in a direction in which the moving member slides with respect to the body, and a seal member that is arranged in a clearance formed between the body and the moving member, and that is arranged in a region, which is farther from the high-pressure chamber than the through-hole is and which has a cross section of which an area is less than the area of the cross section of the first region present at the first distance from the communication hole.

12. The sealed lash adjuster according to claim 11, wherein a third distance, from the communication hole, is less than the area of the cross section of the first region present at the first distance from the communication hole and greater than the area of the cross section of the second region present at the second distance from the communication hole, the cross section of a third region present at the third distance from the communication hole being perpendicular to the line extending in the direction in which the moving member slides with respect to the body.

13. The sealed lash adjuster according to claim 11, wherein the gas is sealed in the reservoir chamber after being pressurized until a pressure of the gas is higher than atmospheric pressure.

14. The sealed lash adjuster according to claim 11, wherein an elastic member is arranged in the high-pressure chamber.

15. The sealed lash adjuster according to claim 11, wherein a force applying member is the liquid that is sealed in the high-pressure chamber so that a pressure in the high-pressure chamber maintains higher than atmospheric pressure when the lash adjuster is in use and the moving member protrudes from the body to a fullest extent.

16. The sealed lash adjuster according to claim 11, wherein an opening portion of the through-hole, which opens into the reservoir chamber, is below a liquid level of the liquid.

17. The sealed lash adjuster according to claim 16, wherein the opening portion of the through-hole, which opens into the reservoir chamber, is closer to the high-pressure chamber than an opening portion of the through-hole, which opens at the sliding face, is, in the direction in which in which the moving member slides with respect to the body.

* * * * *